United States Patent [19]

Mihayashi et al.

[11] Patent Number: 4,729,944

[45] **Date of Patent: * Mar. 8, 1988**

[54] SILVER HALIDE PHOTOGRAPHIC LIGHT-SENSITIVE MATERIAL

[75] Inventors: Keiji Mihayashi; Shunji Takada; Keiichi Adachi; Seiji Ichijima; Hidetoshi Kobayashi, all of Kanagawa, Japan

[73] Assignee: Fuji Photo Film Co., Ltd., Kanagawa, Japan

[ * ] Notice: The portion of the term of this patent subsequent to Jan. 13, 2004 has been disclaimed.

[21] Appl. No.: 802,603

[22] Filed: Nov. 25, 1985

Related U.S. Application Data

[63] Continuation of Ser. No. 599,868, Apr. 13, 1984, abandoned.

[30] Foreign Application Priority Data

Apr. 14, 1983 [JP] Japan ..... 58-66006

[51] Int. Cl.[4] ..... G03C 7/26; G03C 7/32

[52] U.S. Cl. ..... 430/376; 430/505; 430/543; 430/553; 430/555; 430/557; 430/558; 430/567

[58] Field of Search ..... 430/505, 553, 555, 557, 430/558, 567, 376, 543

[56] References Cited

U.S. PATENT DOCUMENTS

| | | | |
|---|---|---|---|
| 3,733,201 | 5/1973 | Barr | 430/387 |
| 4,040,829 | 8/1977 | Ohmatsu et al. | 430/505 |
| 4,420,556 | 12/1983 | Booms et al. | 430/557 |
| 4,436,808 | 3/1984 | Yagihara et al. | 430/505 |
| 4,461,826 | 7/1984 | Yamashita et al. | 430/567 |
| 4,536,472 | 8/1985 | Kato et al. | 430/557 |

*Primary Examiner*—Richard L. Schilling
*Attorney, Agent, or Firm*—Sughrue, Mion, Zinn, Macpeak and Seas

[57] ABSTRACT

A silver halide photographic light-sensitive material comprising a support having thereon at least one silver halide emulsion layer, wherein the photographic light-sensitive material has a layer containing both a non-diffusible coupler which forms a properly smearing diffusible dye upon reaction with the oxidation product of a color developing agent and a silver halide emulsion in which a diameter corresponding to the projected area of grains that takes 40% or more of the projected area of whole silver halide grains is 1.5 μm or more.

The silver halide photographic light-sensitive material has improved graininess as well as has high sensitivity.

19 Claims, No Drawings

SILVER HALIDE PHOTOGRAPHIC LIGHT-SENSITIVE MATERIAL

This is a continuation of application Ser. No. 599,868 filed Apr. 13, 1984, now abandoned.

FIELD OF THE INVENTION

The present invention relates to a silver halide photographic light-sensitive material and more particularly to a silver halide color photographic light-sensitive material for photographing having improved graininess in spite of having high sensitivity.

BACKGROUND OF THE INVENTION

Recently, in the field of silver halide photographic light-sensitive materials, in particular, used for photographing, those having high sensitivity as typically illustrated by ISO 1,000 films, etc. or those having high image quality and high resolving power suitable for use in small format cameras as typically illustrated by 110 sized cameras or disc cameras have been desired.

For the purpose of increasing the sensitivity, investigations have been made on various techniques including, e.g., large size silver halide grains, couplers with high activities, accelerated development, etc. However, the increase in sensitivity based on large size silver halide grains seems to be reaching its limit, as reported by G. C. Farnell and J. B. Chanter in *Journal of Photographic Science,* Vol. 9, page 75 (1961). Accordingly, this technique is not expected to make much contribution in the future. In addition, the use of large size silver halide grains is accompanied by various disadvantages, such as deterioration in graininess, increase in thickness of the emulsion layer, and degradation of preservability. Further, the increase in sensitivity by the use of highly active couplers or the accelerated development is disadvantageous since these techniques not only are accompanied by remarkable deterioration in graininess but also have not made much contribution to the sensitivity.

On the other hand, in order to improve the graininess of color images there have hitherto been attempted to increase the number of silver halide grains and to make due clouds formed by color development indefinite as describes in T. H. James, *Theory of the Photographic Process,* 4th Ed., pages 620–621. However, the attempt at increasing the number of silver halide grains while maintaining a high photographic sensitivity requires an increase in the amount of coated silver and thus causes a reduction in resolving powder. Thus this attempt is disadvantageous in view of cost and photographic properties.

Further, the attempt at improving graininess by diffusion of dyes based on the description in the above-described literature has been disclosed in British Pat. No. 2,080,640A.

It has been surprisingly found that when large size silver halide grains which are intended to obtain high sensitivity are employed in combination with a non-diffusible coupler which forms a properly smearing diffusible dye upon reaction with the oxidation product of a color developing agent (hereinafter, the non-diffusible coupler is simply referred to as a dye diffusible type coupler) in the same layer, not only the graininess is improved but also the sensitivity is further increased compared with a combination of the large size silver halide grains and a conventional coupler providing a non-diffusible dye, although only graininess is improved when a dye diffusible type coupler is employed in combination with silver halide grains having a grain size conventionally used in the same layer, compared with a case wherein a conventional coupler providing a non-diffusible dye is employed therewith. This fact is unexpected from usual knowledge.

SUMMARY OF THE INVENTION

Therefore, an object of the present invention is to provide a silver halide photographic light-sensitive material having high sensitivity.

Another object of the present invention is to provide a silver halide photographic light-sensitive material having both high sensitivity and improved graininess.

Other objects of the present invention will be apparent from the following detailed description and examples.

These objects of the present invention can be attained by a silver halide photographic light-sensitive material comprising a support having thereon at least one silver halide emulsion layer, wherein the photographic light-sensitive material has a layer containing both a non-diffusible coupler which forms a properly smearing diffusible dye upon reaction with the oxidation product of a color developing agent and a silver halide emulsion in which a diameter corresponding to the projected area of grains that takes 40% or more of the projected area of whole silver halide grains is 1.5 μm or more.

DETAILED DESCRIPTION OF THE INVENTION

The mechanism by which the increased sensitivity as well as the improved graininess are achieved by means of incorporating a silver halide emulsion of coarse grains and a dye diffusible type coupler into the same layer has not been entirely clear, but it may be believed to be as follows.

It has been previously expected that appearance of an absorption coefficient of a film is varied depending on some factors such as a size of dye clouds, an absorption coefficient of dye clouds, density of dye clouds, etc. as described in R. J. Gledhill and D. B. Julian, *Journal of Optical Society of America,* Vol. 53, page 239 (1963). It is also well known in the art that dye clouds are spread with dye diffusible type couplers as described above. However, the interrelation between the size of dye clouds, the density of dye clouds and the absorption coefficient of dye clouds and a size of silver halide grains in ordinarily used films or the interrelation between the former and the appearance of absorption coefficient of films are presently not known in the art. The inventors believe it is possible that the combination of size of silver halide grains and a dye diffusible type coupler according to the present invention is suitable for increasing the appearance of absorption coefficient in films and as the results the increases in color density and sensitivity are obtained. The details thereof will become apparent by future investigations.

The dye diffusible type couplers used in the present invention include those compounds represented by the following general formula (A):

$$(Cp)_aX \qquad (A)$$

wherein Cp represents a diffusible coupler component which forms a properly smearing of dye images and improves graininess; X represents a component which is bonded to the coupling position of the coupler component, which is released upon a reaction with an oxidation product of a color developing agent and which contains a ballast group having from 8 to 32 carbon atoms; and a represents 1 or 2.

An amount of the dye diffusible type coupler being added is from 0.005 mol to 0.5 mol, preferably from 0.01 mol to 0.1 mol, per mol of silver halide present in the layer to be added.

Of the couplers represented by the general formula (A), preferred couplers are represented by the following general formulae (I), (II) and (III):

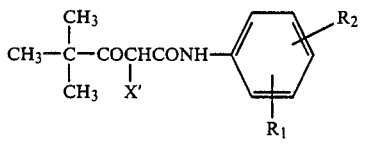
(I)

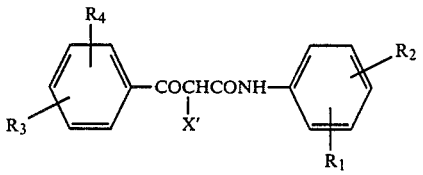
(II)

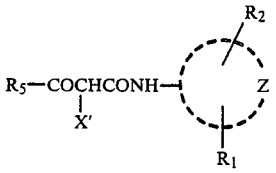
(III)

wherein $R_1$, $R_2$, $R_3$ and $R_4$, which may be the same or different, each represents a hydrogen atom, a halogen atom, an alkyl group (e.g., a methyl group, an ethyl group, an isopropyl group, a hydroxyethyl group, etc.), an alkoxy group (e.g., a methoxy group, an ethoxy group, a methoxyethoxy group, etc.), an aryloxy group (e.g., a phenoxy group, etc.) an acylamino group (e.g., an acetylamino group, a trifluoroacetylamino group, etc.), a sulfonamino group (e.g., a methanesulfonamino group, a benzenesulfonamino group, etc.), a carbamoyl group, a sulfamoyl group, an alkylthio group, an alkylsulfonyl group, an alkoxycarbonyl group, a ureido group, a cyano group, a carboxyl group, a hydroxy group, or a sulfo group; $R_5$ represents an alkyl group (e.g., a methyl group, an ethyl group, tert-butyl group, etc.), an aryl group (e.g., a phenyl group, a 4-methoxyphenyl group, etc.) or an alkoxy group (e.g., a methoxy group, an ethoxy group, etc.), provided that the total number of carbon atoms included in $R_1$, $R_2$, $R_3$, $R_4$ and $R_5$ is not more than 10; Z represents a non-metal atomic group necessary to form a heterocyclic group (e.g., a 2-pyridyl group, a 4-pyridyl group, a 2-quinolyl group, etc.); and X' represents a group which contains a so-called ballast group having from 8 to 32 carbon atoms, providing non-diffusibility to the coupler, and which is capable of being released upon a coupling reaction with an oxidation product of an aromatic primary amine developing agent.

In more detail, the group represented by X' is an acyloxy group, a sulfonyloxy group, a sulfinyloxy group, a sulfamoyloxy group, a carbamoyloxy group, a thiocarbamoyloxy group, an oxamoyloxy group or a group represented by the following general formula (IV) or (V):

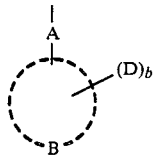
(IV)

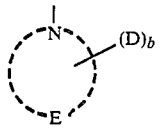
(V)

wherein A represents an oxygen atom or a sulfur atom; B represents a non-metal atomic group necessary to form an aryl ring or a heterocyclic ring; and E represents a non-metal atomic group necessary to form a 5-membered or 6-membered heterocyclic ring together with the nitrogen atom; these rings may be further condensed with an aryl ring or a heterocyclic ring; D represents a ballast group; and b represents a positive integer, when b is more than 1, D may be the same or different, and the total number of carbon atoms included is from 8 to 32. D may be bonded to the condensed ring to the group of

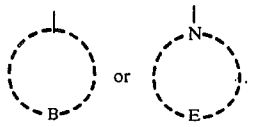

D may contain a connecting group, e.g., —O—, —S—, —COO—, —CONH—, —$SO_2$NH—, —NHCONH—, —$SO_2$—, —CO—,

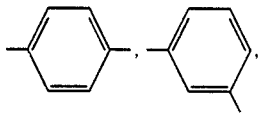

—NH—, etc.

Of the couplers represented by the general formula (A), other preferred couplers are represented by the following general formulae (VI), (VII), (VIII) and (IX):

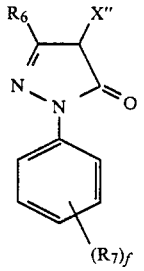
(VI)

-continued (VII)

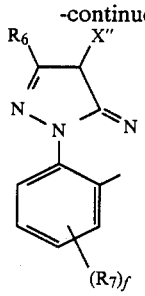

(VIII)

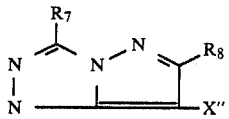

(IX)

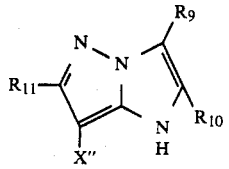

wherein $R_6$ represents an acylamino group (e.g., a propanamido group, a benzamido group, etc.), an anilino group (e.g., a 2-chloroanilino group, a 5-acetamidoanilino group, etc.), or a ureido group (e.g., a phenylureido group, a butaneureido group, etc.); $R_7$ and $R_8$ each represents a halogen atom, an alkyl group (e.g., a methyl group, an ethyl group, etc.), an alkoxy group (e.g., a methoxy group, an ethoxy group, etc.), an acylamino group (e.g., an acetamido group, a benzamido group, etc.), an alkoxycarbonyl group (e.g., a methoxycarbonyl group, etc.), an N-alkylcarbamoyl group (e.g., an N-methylcarbamoyl group, etc.), a ureido group (e.g., an N-methylureido group, etc.), a cyano group, an aryl group (e.g., a phenyl group, a naphthyl group, etc.), an N,N-dialkylsulfamoyl group, a nitro group, a hydroxy group, a carboxyl group, an aryloxy group, etc.; f represents an integer of from 0 to 4, when f is 2 or more, $R_7$ may be the same or different; $R_9$, $R_{10}$ and $R_{11}$ each represents a hydrogen atom, an alkyl group (e.g., a methyl group, a propyl group, a cyclohexyl group, etc.), an aryl group (e.g., a phenyl group, a 3-acetamidophenyl group etc.), a heterocyclic group (e.g., an imidazolyl group, a furyl group, etc.), a cyano group, an alkoxy group (e.g., an ethoxy group, a benzyloxy group, etc.), an aryloxy group (e.g., a phenoxy group, etc.), an acylamino group (e.g., a butanamido group, an octanamido group, etc.), an anilino group (e.g., a 2-chloroanilino group, a 4-methoxyanilino group, etc.), a ureido group (e.g., a phenylureido group, etc.), a sulfamoylamino group (e.g., an N,N-diisopropylsulfamoylamino group, etc.)., an alkylthio group (e.g., an octylthio group, etc.), an arylthio group (e.g., a phenylthio group, etc.), an alkoxycarbonyl group (e.g., an ethoxycarbonyl group, etc.), an alkoxycarbonylamino group (e.g., a benzyloxycarbonylamino group, etc.), a sulfonamido group (e.g., a methanesulfonamido group, etc.), a carbamoyl group (e.g., an N,N-dibutylcarbamoyl group, etc.), a sulfamoyl group (e.g., an N,N-diethylsulfamoyl group, etc.), or a sulfonyl group (e.g., a methanesulfonyl group, etc.), provided that the total number of carbon atoms included in $R_6$ and $(R_7)_f$ of the general formulae (VI) and (VII), in $R_7$ and $R_8$ of the general formula (VIII) or in $R_9$, $R_{10}$ and $R_{11}$ of the general formula (IX) is not more than 10; and X'' represents a group which is bonded to the coupling position through an oxygen atom, a nitrogen atom or a sulfur atom and which is capable of being released upon a coupling reaction.

In more detail, the group represented by X'' is a group represented by the following general formula (X), (XI), (XII), (XIII) or (XIV):

$$-S-R_{12} \quad (X)$$

$$-O-R_{12} \quad (XI)$$

(XII)

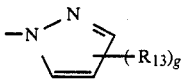

(XIII)

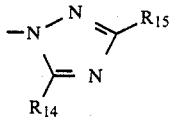

(XIV)

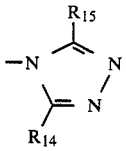

wherein $R_{13}$ represents an aliphatic group, an aromatic group or a heterocyclic group; g represents an integer of 1 to 3; $R_{13}$ represents a hydrogen atom, a halogen atom (e.g., a chlorine atom, etc.), an acylamino group (e.g., a tetradecanamido group, a 2-(2,4-di-tert-amylphenoxy)butanamido group, etc.), an alkoxy group (e.g., a dodecyloxy group, etc.), an alkoxycarbonyl group (e.g., a dodecyloxycarbonyl group, etc.), a sulfamoyl group (e.g., an N-dodecylsulfamoyl group, etc.), a sulfonamido group (e.g., a hexadecylsulfonylamino group, etc.), a carbamoyl group (e.g., an N-dodecylcarbamoyl group, etc.), an imido group (e.g., an octadecenylsuccinimido group, etc.), an aliphatic group, an aromatic group or a heterocyclic group, when g is two or more, $R_{13}$ may be the same or different; and $R_{14}$ and $R_{15}$ each has the same meaning as defined for $R_{13}$.

Where $R_{12}$, $R_{13}$, $R_{14}$ or $R_{15}$ represents an aromatic group (particularly, a phenyl group), the aromatic group may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, or an alkyl substituted succinimido group, etc. In such a case the alkyl moiety may contain an aromatic group such as a phenylene group in its chain. Also, the phenyl group represented by $R_{12}$, $R_{13}$, $R_{14}$ or $R_{15}$ may be substituted with an aryloxy group, an aryloxycarbonyl group, an arylcarbamoyl group, an arylamido group, an arylsulfamoyl group, an arylsulfonamido group or an arylureido group, etc. and the aryl moiety in these substituents may further substituted with an alkyl group. Further, the phenyl group represented by $R_{12}$, $R_{13}$, $R_{14}$ or $R_{15}$ may be substituted with an amino group, a hydroxy group, a carboxy group, a sulfo group, a nitro group, an alkoxy group, a cyano group, a thiocyano group or a halogen atom.

Where $R_{12}$, $R_{13}$, $R_{14}$ or $R_{15}$ represents an aliphatic group, the aliphatic group may be substituted or unsubstituted, chain or cyclic, or saturated or unsaturated. Preferred examples of the substituents for the alkyl group include an alkoxy group, an aryloxy group, an amino group, an acylamino group, a halogen atom, an aryl group, an alkoxycarbonyl group, a sulfonamido group, a sulfamoyl group, an alkylthio group, a carboxy group, an alkylsulfonyl group, an imido group, an alkanoyloxy group, aan arylcarbonyloxy group, etc., and these groups per se may further be substituted.

When $R_{12}$, $R_{13}$, $R_{14}$ and $R_{15}$ represents a heterocyclic group, examples of the hetrocyclic ring include thiophene, furan, pyran, pyrrole, pyrazole, pyridine, pyrazine, pyrimidine, pyridazine, indolizine, imidazole, thiazole, oxazole, triazine, thiadiazine, oxazine, tetrazole, benzimidazole, etc. The heterocyclic group may be substituted with a substituent as defined for the aromatic group or the aliphatic group described above.

The total number of carbon atoms included in $R_{12}$ of the general formulae (X) and (XI), in $(R_{13})_g$ of the general formula (XII) or in $R_{14}$ and $R_{15}$ of the general formulae (XIII) and (XIV) is from 8 to 32.

Of the couplers represented by the general formula (A), other preferred couplers are represented by the following general formulae (XV) and (XVI):

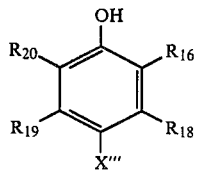

(XV)

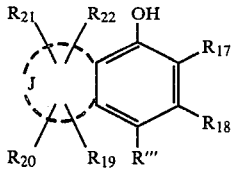

(XVI)

wherein $R_{16}$ represents a hydrogen atom, an aliphatic group having 10 or less carbon atoms (e.g., an alkyl group such as a methyl group, an isopropyl group, an acyl group, a cyclohexyl group, an octyl group, etc.), an alkoxy group having 10 or less carbon atoms (e.g., a methoxy group, an isopropoxy group, a pentyloxy group, etc.), an aryloxy group (e.g., a phenoxy group, a p-tert-butylphenoxy group, etc.), an acylamido group, a sulfonamido group and a ureido group represented by the general formulae (XVII) to (XIX) as described below, or a carbamoyl group represented by the general formula (XX) as described below.

$$-NH-CO-G \quad \text{(XVII)}$$

$$-NH-SO_2-G \quad \text{(XVIII)}$$

$$-NHCONH-G \quad \text{(XIX)}$$

$$-CON\begin{matrix} G \\ G' \end{matrix} \quad \text{(XX)}$$

wherein G and G', which may be the same or different, each represents a hydrogen atom (provided that G and G' are not hydrogen atoms at the same time and that the total number of carbon atoms included in G and G' is from 1 to 12), an aliphatic group having from 1 to 12 carbon atoms, preferably a straight chain or branched chain alkyl group having from 4 to 10 carbon atoms or a cyclic alkyl group (e.g., a cyclopropyl group, a cyclohexyl group, a norbornyl group, etc.), an aryl group (e.g., a phenyl group, a naphthyl group, etc.) or a heterocyclic group (e.g., a benzothiazolyl group, etc.), and the alkyl, aryl and heterocyclic groups may be substituted with a halogen atom (e.g., a fluorine atom, a chlorine atom, etc.), a nitro group, a cyano group, a hydroxy group, a carboxy group, an amino group (e.g., an amino group, an alkylamino group, a dialkylamino group, an anilino group, an N-alkylanilino group, etc.), an alkyl group (e.g., those as described above), an aryl group (e.g., a phenyl group, an acetylaminophenyl group, etc.), an alkoxycarbonyl group (e.g., a butyloxycarbonyl group, etc.), an acyloxycarbonyl group, an amido group (e.g., an acetamido group, a methanesulfonamido group, etc.), an imido group (e.g., a succinimido group, etc.), a carbamoyl group (e.g., an N,N-diethylcarbamoyl group, etc.), a sulfamoyl group (e.g., an N,N-diethylsulfamoyl group, etc.), an alkoxy group (e.g., an ethoxy group, a butyloxy group, an octyloxy group, etc.), an aryloxy group (e.g., a phenoxy group, a methylphenoxy group, etc.), a sulfonyl group (e.g., a propylsulfonyl group, a phenylsulfonyl group, etc.), etc. $R_{16}$ may contain commonly used substituents in addition to the above-described substituents.

$R_{17}$ represents a hydrogen atom, an aliphatic group having 12 or less carbon atoms, preferably an alkyl group having from 1 to 10 carbon atoms, or a carbamoyl group represented by the general formula (XX) described above.

$R_{18}$, $R_{19}$, $R_{20}$, $R_{21}$ and $R_{22}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group.

In greater detail, $R_{18}$ represents a hydrogen atom, a halogen atom (e.g., a chlorine atom, a bromine atom, etc.), a primary, secondary or tertiary alkyl group having from 1 to 12 carbon atoms (e.g., a methyl group, a propyl group, an isopropyl group, a n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)-ethyl group, a 2-aminoethyl group, etc.), an alkylthio group (e.g., an octylthio group, etc.), an aryl group (e.g., a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, etc.), a heterocyclic group (e.g., a benzofuranyl group, a furyl group, a thiazolyl group, a benzothiazolyl group, a naphthothiazolyl group, an oxazolyl group, a benzoxazolyl group, a naphthoxazolyl group, a pyridyl group, a quinolinyl group, etc.), an amino group (e.g., an amino group, a methylamino group, a diethylamino group, a dodecylamino group, a phenylamino group, a tolylamino group, a 4-cyanophenylamino group, a 2-trifluoromethylphenylamino group, a benzothiazolylamino group, etc.), a carbonamido group (e.g., an alkylcarbonamido group such as an ethylcarbonamido group, a decyclcarbonamido group, etc., an arylcarbonamido group such as a phenylcarbonamido group, a 2,4,6-trichlorophenylcarbonamido group, a 4-methylphenylcarbonamido group, a 2-ethoxyphenylcarbonamido group, a naphthylcarbonamido group, etc., a heterocyclic carbonamido group such as a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.), a sulfonamido group (e.g., an alkylsulfonamido group such as a butylsulfonamido group, a dodecylsulfonamido group, a phenylethylsulfonamido group, etc., an arylsulfonamido group such as a phenylsulfonamido group, a 2,4,6-trichlorophenylsulfonamido group, a 2-methoxyphenylsulfonamido group, a 3-carboxyphenylsulfonamido group, a naphthylsulfonamido group, etc., a heterocyclic sulfonamido group such as a thiazolylsulfonamido group, a benzothiazolylsulfonamido group, an imidazolylsulfonamido group, a benzimidazolylsulfonamido group, a pyridylsulfonamido group, etc.), a sulfamyl group (e.g., an alkylsulfamyl group such as a propylsulfamyl group, an octylsulfamyl group, etc., an arylsulfamyl group such as a phenylsulfamyl group, a 2,4,6-trichlorophenylsulfamyl group, a 2-methoxyphenylsulfamyl group, a naphthylsulfamyl group, etc., a heterocyclic sulfamyl group such as a thiazolylsulfamyl group, a benzothiazolylsulfamyl group, an oxazolylsulfamyl group, a benzimidazolylsulfamyl group, a pyridylsulfamyl group, etc.), or a carbamyl group (e.g., an alkylcarbamyl group such as an ethylcarbamyl group, an octylcarbamyl group, etc., an arylcarbamyl group such as a phenylcarbamyl group, a 2,4,6-trichlorophenylcarbamyl group, etc., a heterocyclic carbamyl group such as a thiazolylcarbamyl group, a benzothiazolylcarbamyl group, an oxazolylcarbamyl group, an imidazolylcarbamyl group, a benzimidazolylcarbamyl group, etc.).

$R_{19}$, $R_{20}$, $R_{21}$ and $R_{22}$ can also represent in detail those described in detail for $R_{18}$.

J represents a non-metal atomic group necessary to form a 5-membered or 6-membered ring, e.g., a benzene ring, a cyclohexene ring, a cyclopentene ring, a thiazole ring, an oxazole ring, an imidazole ring, a pyridine ring, a pyrrole ring, etc. Of these rings, a benzene ring is preferred.

X''' represents a group which contains a group having from 8 to 32 carbon atoms, which is bonded to the coupling position through —O—, —S—, or —N=N—, and which is capable of being released upon a coupling reaction with an oxidation product of an aromatic primary amine developing agent. Preferred examples are an alkoxy group, an aryloxy group, an alkylthio group, and an arylthio group, each having from 8 to 32 carbon atoms. These groups may further contain a divalent group such as —O—, —S—, —NH—, —CONH—, —COO—, $—SO_2NH—$, —SO—, $—SO_2—$, —CO—,

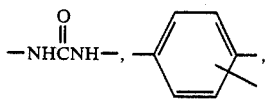

etc. Moreover, it is particularly preferred that these groups contain a group which is dissociated with alkali such as —COOH, $—SO_3H$, —OH and $—SO_2NH_2$, etc.

By suitably combining $R_{16}$, $R_{17}$, $R_{18}$, $R_{19}$, $R_{20}$, $R_{21}$, $R_{22}$ and X''', couplers can be made substantially diffusion-resistant.

Specific examples of the dye diffusible type couplers used in the present invention are set forth below, but the present invention should not be construed as being limited thereto.

Y-1

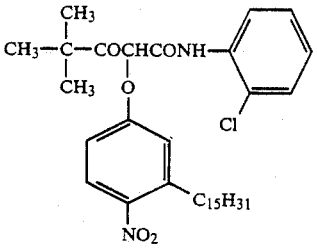

Y-2

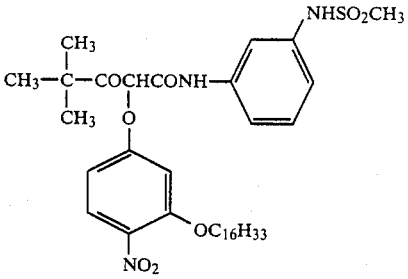

Y-3

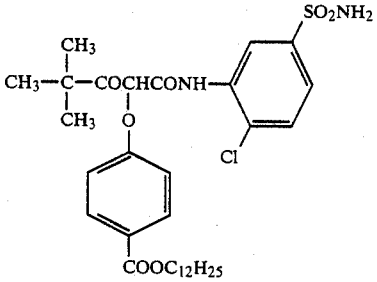

Y-4

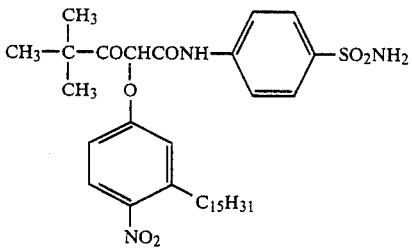

-continued
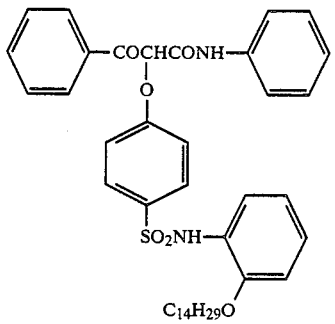
Y-5
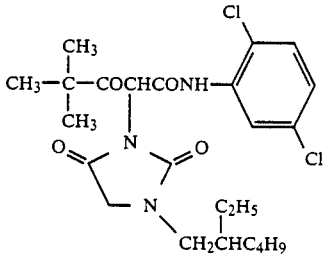
Y-6
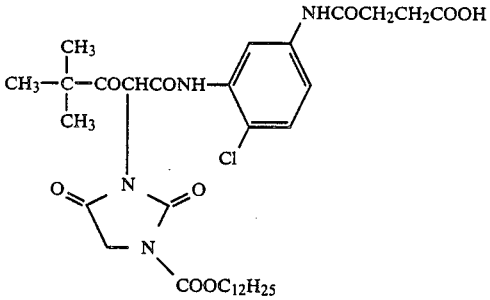
Y-7
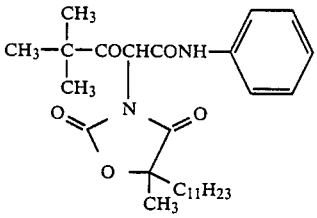
Y-8
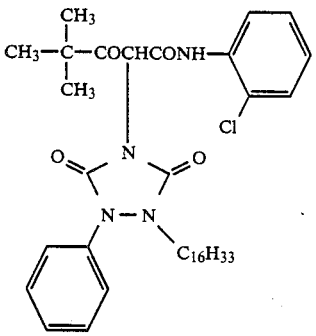
Y-9
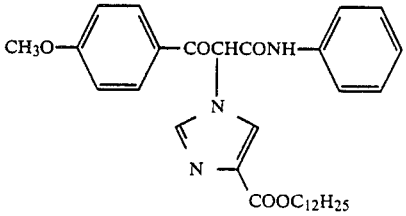
Y-10
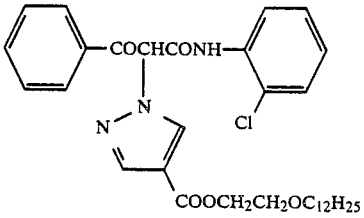
Y-11
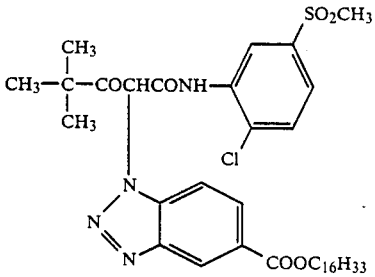
Y-12

-continued
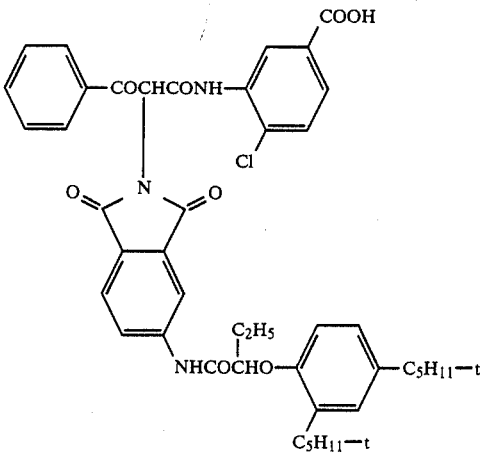
Y-13
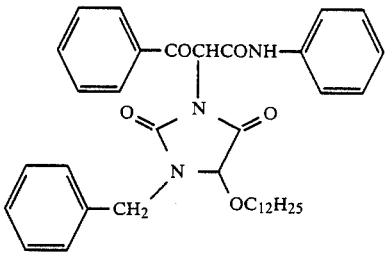
Y-14
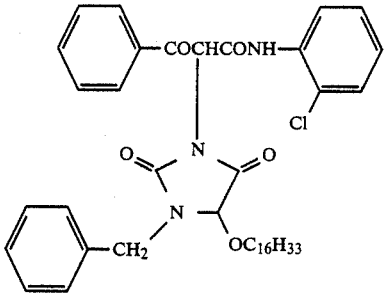
Y-15
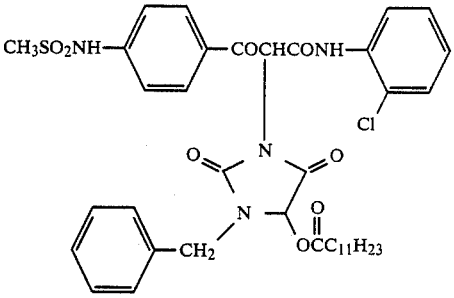
Y-16
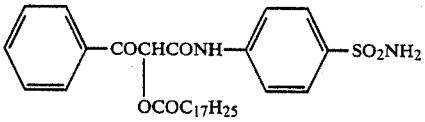
Y-17
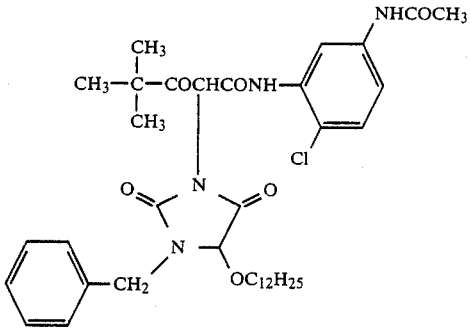
Y-18
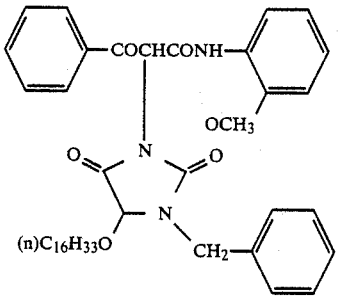
Y-19
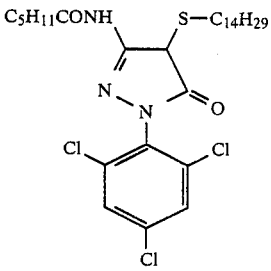
M-1

-continued
M-2
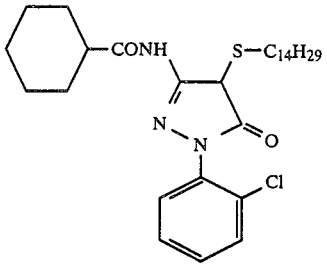
M-3
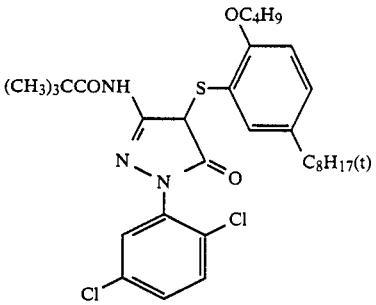
M-4
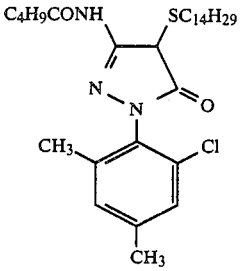
M-5
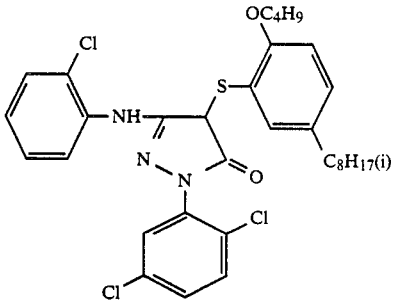
M-6
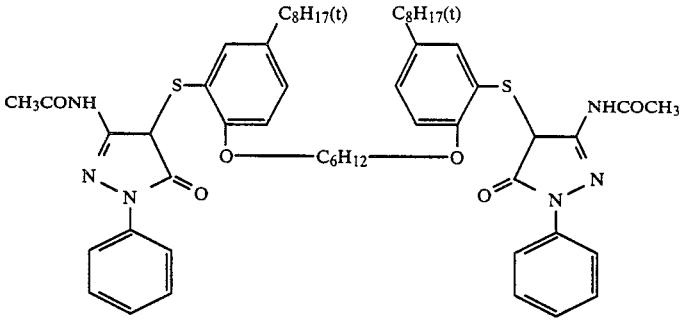
M-7
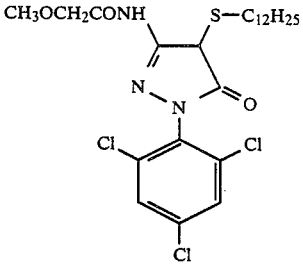
M-8
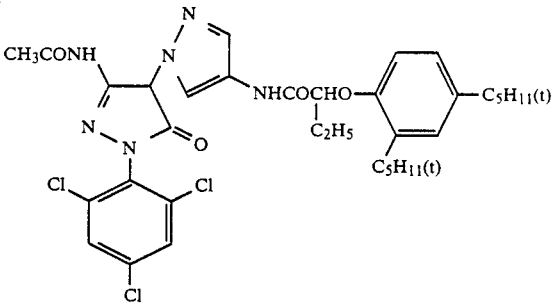
M-9
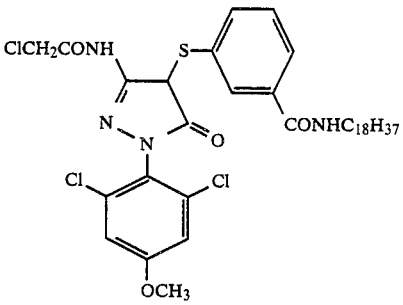
M-10
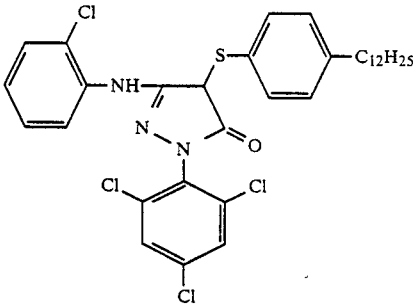

-continued
M-11
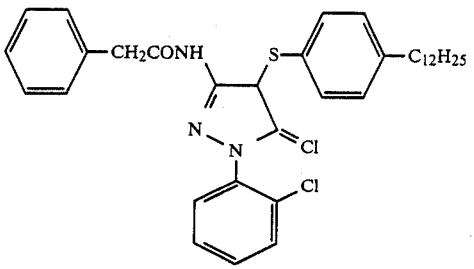
M-12
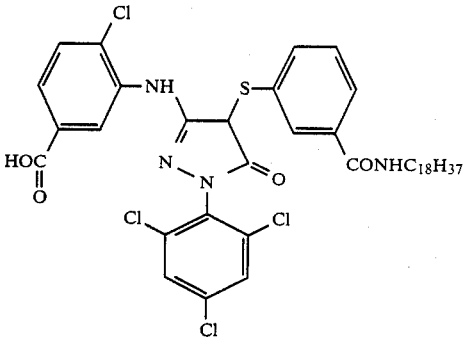
M-13
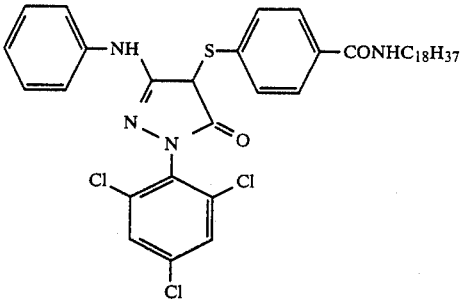
M-14
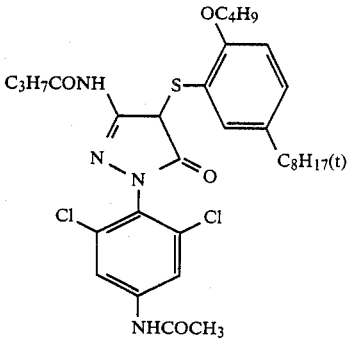
M-15
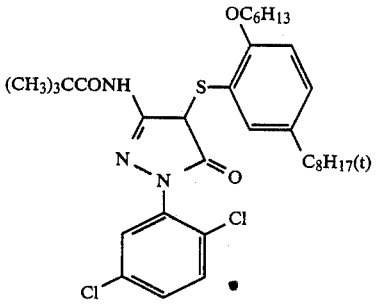
M-16
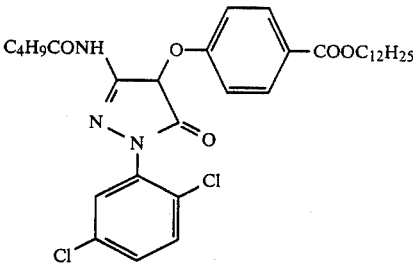
M-17
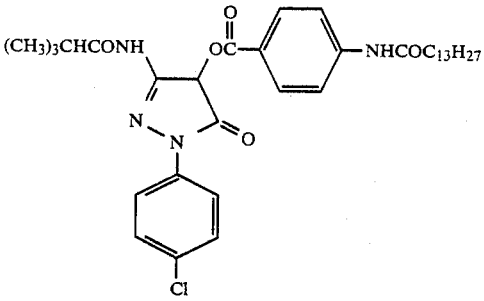
M-18
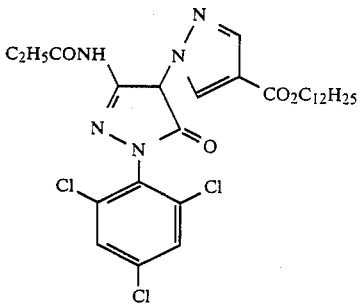
M-19
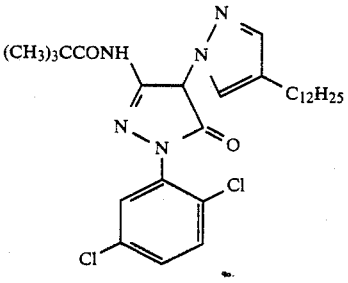
M-20
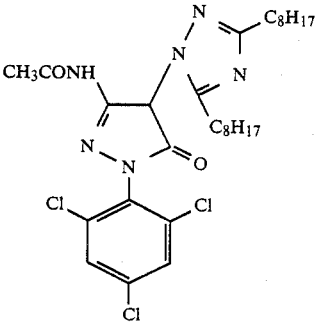

-continued
M-21
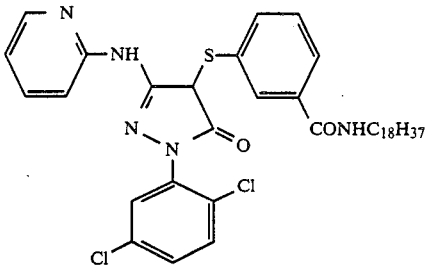
M-22
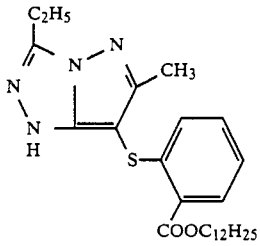
M-23
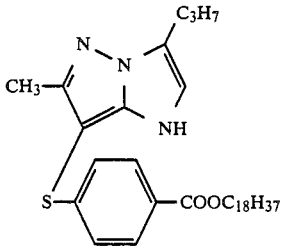
M-24
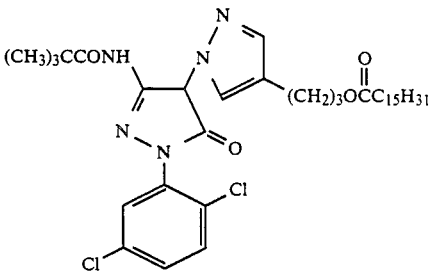
M-25
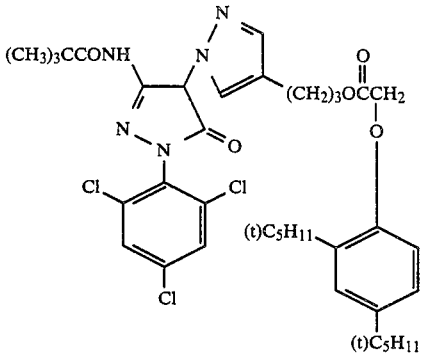
M-26
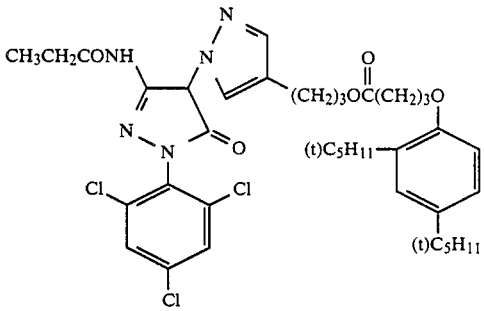
These compounds according to the present invention can be synthesized by methods as described, for example, in U.S. Pat. Nos. 4,264,723, 3,227,554, 4,310,619 and 4,301,235, Japanese Patent Application (OPI) Nos. 4044/82, 126833/81 and 122935/75, etc.
C-1
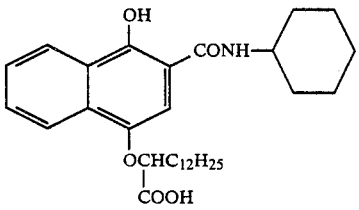
C-2
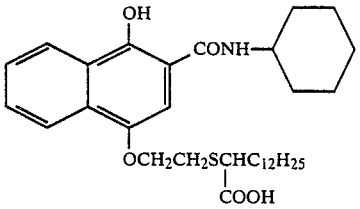
-continued
C-3
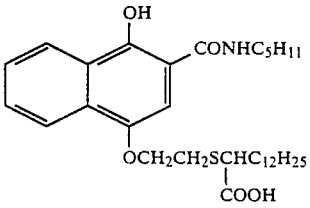
C-4
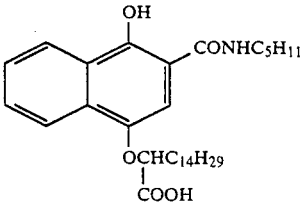
C-5
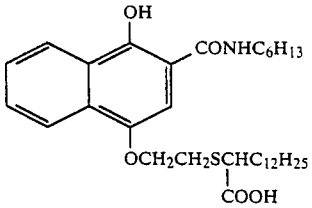

-continued
C-6
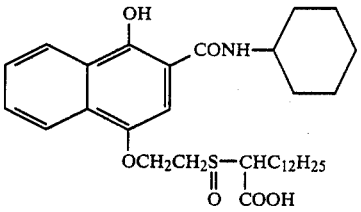
C-7
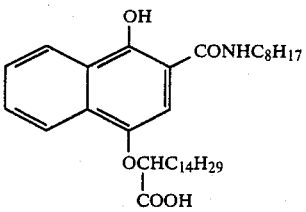
C-8
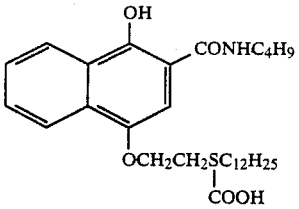
C-9
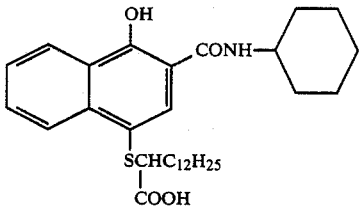
C-10
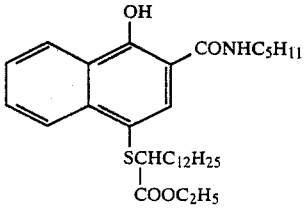
C-11
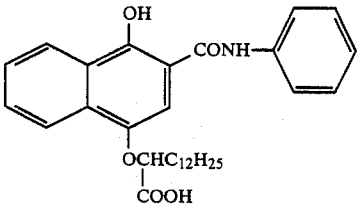
C-12
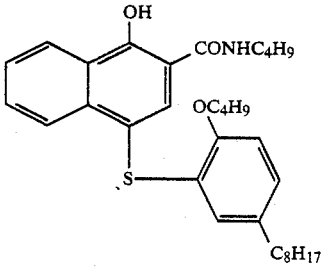
-continued
C-13
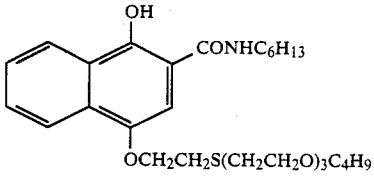
C-14
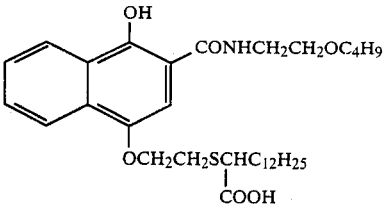
C-15
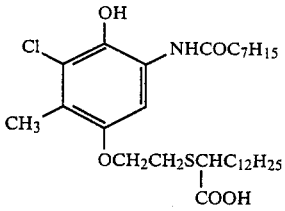
C-16
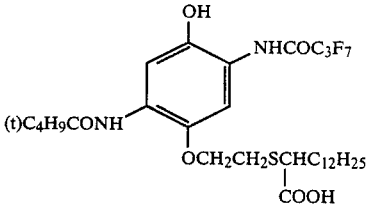
C-17
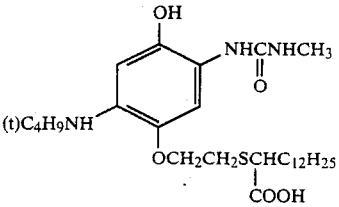
C-18
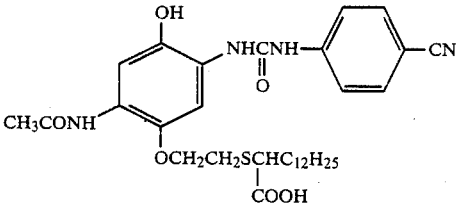
C-19
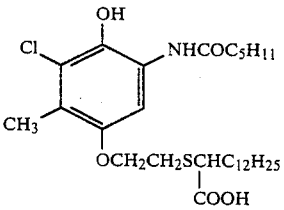

-continued

C-20

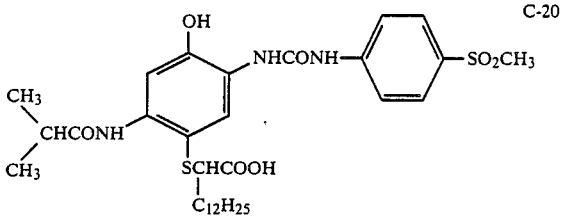

These compounds according to the present invention can be easily synthesized by methods as described, for example, in Japanese Patent Application (OPI) Nos. 1938/81, 3934/82 and 105226/78, etc.

Further, the dye diffusible type couplers according to the present invention may be polymer couplers as described in Japanese Patent Application (OPI) No. 145944/83, etc.

It is preferred that the dye diffusible type couplers which can be used in the present invention are those which have the molecular weight of 250 to 700 after the formation of dyes in cases wherein the couplers do not have dissociation groups in their molecules, and those which have the molecular weight of 450 to 1200 after the formation of dyes in cases wherein the couplers have dissociation groups in their molecule.

Two or more kinds of the dye diffusible type couplers according to the present invention can be employed in the same layer. Also, the diffusible type couplers can be employed in combination with conventional non-diffusible dye forming couplers as described hereinafter.

In order to incorporate the dye diffusible type couplers according to the present invention into a silver halide emulsion layer, known methods, for example, the method as described in U.S. Pat. No. 2,322,027, etc. can be used. For example, the coupler is dissolved in, organic solvents having a high boiling point for example, phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, dioctyl azelate, etc.), trimesic acid esters (e.g., tributyl trimesate, etc.), or organic solvents having a boiling point of from about 30° to about 150° C., for example, lower alkyl acetates such as ethyl acetate and butyl acetate, ethyl propionate, etc., sec-butyl alcohol, methyl isobutyl ketone, β-ethoxyethyl acetate, methyl cellosolve acetate, etc. and, thereafter, is dispersed in a hydrophilic colloid. The above-described organic solvents having a high boiling point and organic solvents having a low boiling point may be used in combination with each other. In addition, a dispersion procedure using polymers, as described in Japanese Patent Publication No. 39853/76 and Japanese Patent Applicaton (OPI) No. 59943/76, can be used.

When the couplers contain an acid group, e.g., a carboxyl group, a sulfonyl group, etc., they are incorporated into a hydrophilic colloid in the form of an aqueous alkaline solution.

Organic solvents having a high boiling point which can be used are described in, for example, U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1032/72, British Pat. No. 1,222,753, U.S. Pat. No. 3,936,303, Japanese Patent Application (OPI) Nos. 26037/76 and 82078/75, U.S. Pat. Nos. 2,353,262, 2,852,382, 3,554,755, 3,676,137, 3,676,142, 3,700,454, 3,748,141 and 3,837,863, West German Patent (OLS) No. 2,538,889, Japanese Patent Application (OPI) Nos. 27921/76, 27922/76, 26035/76, 26036/76 and 62632/75, Japanese Patent Publication No. 29461/74, U.S. Pat. Nos. 3,936,303 and 3,748,141, Japanese Patent Application (OPI) No. 1521/78, etc.

Further, the dye diffusible type couplers according to the present invention may be incorporated into a silver halide emulsion layer by loading the couplers into a polymer latex using the methods as described in Japanese Patent Application (OPI) Nos. 39853/76, 59942/76 and 32552/79, U.S. Pat. No. 4,199,363, etc. and then adding to the silver halide emulsion.

As a binder or a protective colloid for photographic emulsions, it is advantageous to use gelatin, although other hydrophilic colloids can be used. For example, proteins, such as gelatin derivatives, graft polymers of gelatin and other polymers, albumin, casein, etc.; cellulose derivatives, such as hydroxyethyl cellulose, carboxymethyl cellulose, cellulose sulfuric acid esters, etc.; saccharide derivatives, such as sodium alginate, starch derivatives, etc.; a wide variety of hydrophilic synthetic homo- or copolymers, such as polyvinyl alcohol, polyvinyl alcohol partial acetal, poly(N-vinyl) pyrrolidone, polyacrylic acid, polymethacrylic acid, polyacrylamide, polyvinyl imidazole, polyvinyl pyrazole, etc. can be used.

In addition to lime-processed gelatin, acid-processed gelatin and enzyme-processed gelatin as described in *Bull. Soc. Sci. Phot. Japan,* No. 16, page 30 (1966) may be used as gelatin.

The projected area of silver halide grains used in the present invention means a projected area obtained from microphotography using a well known method in the art (usually electron microscopic photography) as described in T. H. James, *The Theory of the Photographic Process,* 3rd Ed., pages 36 to 43 (1966). Also, the diameter corresponding to the projected area of silver halide grains is defined as a diameter of a circle which has an area equal to the projected area of silver halide grains.

The silver halide emulsion used in the present invention is necessary to have a diameter corresponding to the projected area of silver halide grains that take 40% or more of the projected area of whole silver halide grains 1.5 μm or more. The size is preferably 1.7 μm or more, more preferably 1.8 μm or more and most preferably 2.0 μm or more. Further, it is preferred that the diameter of grains that takes 50% or more of the projected area of whole grains is 1.5 μm or more and more preferably the diameter of grains that takes 70% or more of the projected area of whole grains being 1.5 μm or more.

The grain size distribution of the emulsion may be narrow or broad.

In the photographic emulsion layer of the photographic light-sensitive material of the invention, any of silver bromide, silver iodobromide, silver iodochlorobromide, silver chlorobromide and silver chloride can be used as the silver halide. Preferred silver halide is silver iodobromide containing 25 mole% or less of silver iodide. Particularly preferred is silver iodobromide containing from 2 to 18 mole% of silver iodide.

Silver halide grains in the photographic emulsion may have a regular crystal structure, e.g., a cubic or octahedral structure, an irregular crystal structure, e.g., a spherical or plate-like structure, or a composite structure thereof. In addition, silver halide grains composed of those having different crystal structures may be used. Further, it is preferred in some cases that the silver halide grains are tabular grains which have an aspect ratio of 3 or more as defined in *Research Disclosure,* No. 22534 (1983).

The inner portion and the surface layer of silver halide grains may be different in phase or may be of the uniform phase. These silver halide grains may be those in which a latent image is formed mainly on the surface thereof, or those in which a latent image is formed mainly in the interior thereof.

Photographic emulsions used in the present invention can be prepared in any suitable manner, e.g., by the methods described in P. Glafkides, *Chimie at Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed. Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions. As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide grains may be carried out in the presence of cadmium salts, zinc salts, lead salts, thallium salts, iridium salts or its complex salts, rhodium salts or its complex salts, iron salts or its complex salts, and the like.

For removal of soluble salts from the emulsion after precipitate formation or physical ripening, a noodle washing process in which gelatin is gelated may be used. In addition, a fluocculation process utilizing inorganic salts, anionic surface active agents, anionic polymers (e.g., polystyrenesulfonic acid, etc.), or gelatin derivatives (e.g., acylated gelatin, carbamoylated gelatin, etc.) may be used.

Silver halide emulsions are usually chemically sensitized. For this chemical sensitization, for example, the methods as described in H. Frieser ed., *Die Grundlagen der Photographischen Prozesse mit Silver-halogeniden,* Akademische Verlagsgesselschaft, pages 675 to 734 (1968) can be used; sulfur sensitization using active gelatin or compounds (e.g., thiosulfates, thioureas, mercapto compounds, rhodanines, etc.) containing sulfur capable of reacting with silver, reduction sensitization using reducing substance (e.g., stannous salts, amines, hydrazine derivatives, formamidinesulfinic acid, silane compounds, etc.), noble metal sensitization using noble metal compounds (e.g., complex salts of Group VIII metals in the Periodic Table, such as Pt, Ir, Pd, etc., as well as gold complex salts), and so forth can be applied alone or in combination with each other.

More specifically, the sulfur sensitization process is described in, for example, U.S. Pat. Nos. 1,574,944, 2,410,689, 2,278,947, 2,728,668 and 3,656,955, etc.; the reduction sensitization process, in, for example, U.S. Pat. Nos. 2,983,609, 2,419,974 and 4,054,458, etc.; and the noble metal sensitization process, in, for example, U.S. Pat. Nos. 2,399,083 and 2,448,060, British Pat. No. 618,061, etc.

Photographic emulsions used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroindazoles, triazoles, benzotriazoles, benzimidazoles (particularly nitro- or halogen-substituted compounds, etc.); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), mercaptopyridines, etc.; the foregoing heterocyclic mercapto compounds further containing a water-soluble group, e.g., a carboxy group or a sulfo group, etc.; thioketo compounds such as oxazolinethione, etc.; azaindenes such as tetraazaindenes (particularly 4-hydroxy-substituted (1,3,3a,7)tetraazaindenes), etc.; benzenethiosulfonic acids; benzene sulfinic acid, and so on.

In connection with specific examples and methods of using them, the descriptions, for example, in U.S. Pat. Nos. 3,954,474, 3,982,947 and 4,021,248, Japanese Patent Publication No. 28660/77, etc. can be referred to.

In photographic emulsion layers or other hydrophilic colloid layers of the photographic light-sensitive material of the invention can be incorporated various surface active agents as coating aids or for other various purposes, e.g., prevention of charging, improvement of slipping properties, emulsification and dispersion, prevention of adhesion, and improvement of photographic characteristics (particularly development acceleration, increase in gradation, and sensitization).

Surface active agents which can be used include nonionic surface active agents, e.g., saponin (steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, silicone/-polyethylene oxide adducts, etc.), glycidol derivatives (e.g., alkenylsuccinic acid polyglyceride alkylphenol polyglyceride, etc.), fatty acid esters of polyhydric alcohols, alkyl esters of sugar, etc.; anionic surface active agents containing acidic groups, such as a carboxyl group, a sulfo group, a phospho group, a sulfuric acid ester group, a phosphoric acid ester group, etc., for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents, such as amino acids, aminoalkylsulfonic acids, aminoalkylsulfuric acid esters, aminoalkylphosphoric acid esters, alkylbetaines, amine oxides, etc.; and cationic surface active agents, e.g., alkylamine salts, aliphatic or aromatic quaternary ammonium salts, heterocyclic quaternary ammonium salts (e.g., pyridinium, imidazolium, etc.), aliphatic or heterocyclic phosphonium or salfonium salts, etc.

The photographic emulsion layers of the photographic light-sensitive material of the invention may contain compounds such as polyalkylene oxide or its ether, ester, amine or like derivatives, thioether compounds, thiomorpholines, quaternary ammonium salt compounds, urethane derivatives, urea derivatives, imidazole derivatives, 3-pyrazolidones, etc. for the purpose of increasing sensitivity or contrast, or of accelerating development. For example, the compounds described in, for example, U.S. Pat. Nos. 2,400,532, 2,423,549, 2,716,062, 3,617,280, 3,772,021 and 3,808,003, British Pat. No. 1,488,991, etc. can be used.

In photographic emulsion layers or other hydrophilic colloid layers of the photographic light-sensitive material of the invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc., and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, etc. For example, the polymers as described in U.S. Pat. Nos. 2,376,005, 2,739,137, 2,853,457, 3,062,674, 3,411,911, 3,488,708, 3,525,620, 3,607,290, 3,635,715 and 3,645,740, British Pat. Nos. 1,186,699 and 1,307,373, etc., can be used.

In photographic processing of layers composed of photographic emulsions in the photographic light-sensitive material of the invention, any of known procedures and known processing solutions, e.g., those described in *Research Disclosure,* (Vol. 176, pages 28 to 30 (RD-17643), can be used. This photographic processing may be a photographic processing (color photographic process) to form dye images depending on the purpose. The processing temperature is usually chosen from between 18° C. and 50° C., although it may be lower than 18° C. or higher than 50° C.

As a specific developing technique, there may be used a method in which a developing agent is incorporated in a photographic light-sensitive material, for example, in an emulsion layer, and the photographic light-sensitive material is developed by treating in an alkaline aqueous solution. Of developing agents, hydrophobic ones can be incorporated by various technique, e.g, by the methods as described in *Research Disclosure,* Vol. 169 (RD-16928), U.S. Pat. No. 2,739,890, British Pat. No. 813,253, West German Pat. No. 1,547,763, etc. This photographic processing may be performed in combination with a treatment of stabilizing silver salts using thiocyanates.

Any fixing solutions which are generally used can be used in the present invention. As fixing agents, thiosulfates and thiocyanates, and in addition, organic sulfur compounds which are known effective as fixing agents can be used. These fixing solutions may contain water-soluble aluminum salts as hardeners.

Formation of dye images can be achieved by the usual method. For example, a negative-positive method (described in, for example, *Journal of the Society of Motion Picture and Television Engineers,* Vol. 61, pages 667 to 701 (1953)) can be employed.

Color developing solutions are usually alkaline aqueous solutions containing color developing agents. As color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc., can be used.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffers, development inhibitors, antifoggants, and so forth. If necessary, water-softening agents, preservatives, organic solvents, development accelerators, dye-forming couplers, competing couplers, fogging agents, auxiliary developing agents, viscosity imparting agents, polycarboxylic acid type chelating agents, antioxidants and the like may be incorporated.

Specific examples of such additives are described in, for example, *Research Disclosure* (RD-17643), U.S. Pat. No. 4,083,723, West German Patent Application (OLS) No. 2,622,950, etc.

After the color development, the photographic emulsion layer is usually bleached. This bleaching process may be performed simultaneously with a fixing process or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of organic acids, such as aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol; etc. can be used. Of these compounds, potassium ferricyanide, iron (III) sodium ethylenediaminetetraacetate, and iron (III) ammonium ethylenediaminetetraacetate are particularly useful. Ethylenediaminetetraacetate acid iron (III) comprex salts are useful in both an independent bleaching solution and a monobath bleach-fixing solution.

In bleaching or bleach-fixing solutions can be incorporated various additives, such as bleach accelerators as described in U.S. Pat. Nos. 3,042,520 and 3,241,966, Japanese Patent Publication Nos. 8506/70 and 8836/70, etc., thiol compounds as described in Japanese Patent Application (OPI) No. 65732/78, etc.

Photographic emulsions used in the present invention may be spectrally sensitized with, for example, methine dyes.

Useful sensitizing dyes are described in, for example, German Pat. No. 929,080, U.S. Pat. Nos. 2,493,748, 2,503,776, 2,519,001, 2,912,329, 3,656,959, 3,672,897 and 4,025,349, British Pat. No. 1,242,588, Japanese Patent Publication No. 14030/69, etc. These sensitizing dyes may be used in the usual manner, or they may be used in combination with each other. Combinations of sensitizing dyes are often used particularly for the purpose of super-sensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, Japanese Patent Application (OPI) Nos. 110618/77 and 109925/77, etc.

In producing the photographic light-sensitive material of the present invention, the photographic emulsion layers and other hydrophilic colloid layers can be coated on a support or another layer by any known coating techniques, such as dip coating, roller coating, curtain coating and extrusion coating. It is advantageous to use the methods as described in U.S. Pat. Nos. 2,681,294, 2,761,791 and 3,526,528.

The present invention includes a multilayer multicolor photographic material having at least two emulsion layers having different spectral sensitivities each other. Multilayer natural color photographic material usually comprises a support, and at least one red-sensitive emulsion layer, at least one green-sensitive emulsion layer, and at least one blue-sensitive emulsion layer provided on the support. These emulsion layers can be provided in any desired order. Usually, a cyan-forming coupler is incorporated in the red-sensitive emulsion layer, a magenta-forming coupler in the green-sensitive emulsion layer, and a yellow-forming coupler in the blue-sensitive layer. In some cases, different combinations can be used.

The photographic light-sensitive material of the present invention is exposed to light by the usual method. For this exposure, a wide variety of known light sources, such as natural light (sunlight), a tungsten lamp, a fluorescent lamp, a mercury lamp, a xenon arc lamp, a carbon arc lamp, a xenon flash lamp, a cathode ray tube flying spot, etc. can be used. The exposure time may be, as a matter of course, between 1/1,000 and 1 second, which is used for the usual cameras, or may be shorter than 1/1,000 second, for example, between $1/10^4$ and $1/10^6$ second using a xenon flash lamp or a cathode ray tube. In addition, it may be longer than 1 second. If necessary, a color filter can be used to control the spectral composition of light to be used for exposure. A laser beam can also be used. In addition, the photographic light-sensitive material of the present invention may be exposed to light emitted from a fluorescent body excited by electron beam, X-ray, $\gamma$-ray, $\alpha$-ray, etc.

In the photographic emulsion layers of the photographic light-sensitive material of the present invention, color-forming couplers, i.e., compounds capable of forming color upon an oxidative coupling reaction with aromatic primary amine developing agents (e.g., phenylenediamine derivatives, aminphenol derivatives, etc.) at color development may be used in combination with the coupler according to the present invention. Examples of magenta couplers include a 5-pyrazolone coupler, a pyrazolobenzimidazole coupler, a cyanoacetylcumaron coupler, an open-chain acylacetonitrile coupler; examples of yellow couplers include an acylacetamide coupler (e.g., benzoylacetanilides, pivaloylacetanilides, etc.); and examples of cyan couplers include a naphthol coupler, a phenol coupler, etc.

These couplers desirably have a hydrophobic group called a ballast group in the molecule thereof, being non-diffusing. The couplers may be either of 4-equivalent or 2-equivalent per silver ion. In addition, they may be colored couplers having a color correction effect, or couplers (so-called DIR couplers) releasing a development inhibitor as development advances. Other than DIR couplers, non-color-forming DIR coupling compounds, the coupling reaction product of which is colorless, and which release a development inhibitor may be incorporated.

Specific examples of magenta color-forming couplers are those as described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc.

Specific examples of yellow color-forming couplers are those as described in, for example, U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Specific examples of cyan color-forming couplers are those as described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 14628/76, 69624/77 and 90932/77, etc.

Specific examples of colored couplers which can be used are those as described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, West German Patent Application (OLS) No. 2,418,959, etc.

Specific examples of DIR couplers which can be used are those as described in, for example, U.S. Pat. Nos. 3,227,554, 3,617,291, 3,632,345, 3,701,783, 3,790,384, 3,933,500, 3,938,996, 4,052,213, 4,157,916, 4,171,223, 4,183,752, 4,187,110 and 4,226,934, West German Patent Application (OLS) Nos. 2,414,006, 2,454,301, 2,454,329, 2,540,959, 2,707,489, 2,709,688, 2,730,824, 2,754,281, 2,835,073, 2,853,362, 2,855,697 and 2,902,681, British Pat. No. 953,454, Japanese Patent Publication Nos. 16141/76, 2776/78 and 34933/80, Japanese Patent Application (OPI) Nos. 122335/74, 69624/77, 154631/77, 7232/78, 9116/78, 15136/78, 20324/78, 29717/78, 13533/78, 143223/78, 73033/79, 114241/79, 115229/79, 145135/79, 84935/80 and 135835/80, *Research Disclosure*, No. 18104, etc. Furthermore, couplers which release a development inhibitor via a timing group as described in British Pat. No. 2010818B, British Patent Application (OPI) No. 2072363A, etc. can be used.

In addition to DIR couplers, compounds capable of releasing a development inhibitor with an advance of development can be incorporated in the photographic light-sensitive material. For example, the compounds as described in, for example, U.S. Pat. Nos. 3,297,445 and 3,379,529, West German Patent Application (OLS) No. 2,417,914, Japanese Patent Application (OPI) Nos. 15271/77 and 9116/78 can be used.

Specific examples of non-color-forming couplers which can be used include those as described in U.S. Pat. Nos. 3,912,513 and 4,204,867, Japanese Patent Application (OPI) No. 152721/77, etc.

Specific examples of infrared couplers which can be used include those as described in U.S. Pat. No. 4,178,183, Japanese Patent Application (OPI) No. 129036/78, *Research Disclosure,* Nos. 13460 and 18732, etc.

Specific examples of black color-forming couplers which can be used include those as described in U.S. Pat. Nos. 4,126,461, 4,137,080 and 4,200,466, Japanese Patent Application (OPI) Nos. 46029/78, 133432/78, 105247/80 and 105248/80, etc.

The emulsion layers of the photographic light-sensitive materials of the present invention can be incorporated with a polymeric coupler, in combination with the coupler according to the invention. Specific examples of polymeric couplers which can be used include those as described in U.S. Pat. Nos. 2,698,797, 2,759,816, 2,852,381, 3,163,625, 3,208,977, 3,211,552, 3,299,013, 3,370,952, 3,424,583, 3,451,820, 3,515,557, 3,767,412, 3,912,513, 3,926,436, 4,080,211, 4,128,427 and 4,215,195, *Research Disclosure,* Nos. 17825, 18815 and 19033, etc.

The emulsion layers according to the present invention can be incorporated with a coupler which release a development accelerator or a fogging agent, in combination with the coupler according to the present invention. Specific examples of such couplers used include those as described in U.S. Pat. Nos. 3,214,377 and 3,253,924, Japanese Patent Application (OPI) Nos. 17437/76, 138636/82 and 150845/82, Japanese Patent Application (OPI) No. 50439/84, etc.

The photographic light-sensitive material of the present invention may contain inorganic or organic hardeners in the photographic emulsion layers and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) can be used alone or in combination with each other.

In the photographic light-sensitive material of the present invention, when dyes, ultraviolet ray absorbers, and the like are incorporated in the hydrophilic colloid layers, they may be mordanted with cationic polymers, etc. For this purpose, the polymers as described in, for example, British Pat. No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Application (OPI) Nos. 47624/75 and 71332/75, etc. can be used.

The photographic light-sensitive material of the present invention may contain therein hydroquinone derivatives, aminophenol derivatives, gallic acid derivatives, ascorbic acid derivatives, etc., as color fog preventing agents.

The photographic light-sensitive material of the present invention may contain ultraviolet absorbers in the hydrophilic colloid layers thereof. Ultraviolet absorbers which can be used include benzotriazole compounds substituted with an aryl group, 4-thiazolidone compounds, benzophenone compounds, cinnamic acid ester compounds, butadiene compounds, benzoxazole compounds, and the like. In addition, polymers having an ultraviolet ray-absorbing ability can be used. These ultraviolet absorbers may be fixed in the foregoing colloid layers.

Specific examples of ultraviolet absorbers include those as described in, for example, U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762, West German Patent Publication No. 1,547,863, etc.

The photographic light-sensitive material of the present invention may contain water-soluble dyes in the hydrophilic colloid layers thereof as filter dyes or for various purposes, e.g., irradiation prevention, etc. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In the present invention, known fading preventing agents as described hereinafter can be used in combination. Color image stabilizers as used herein can be used alone or in combination with each other. Typical known fading preventing agents include hydroquinone derivatives, gallic acid derivatives, p-alkoxyphenols, p-oxyphenol derivatives, bisphenols, etc.

Specific examples of the hydroquinone derivatives used are those as described in, for example, U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc. Specific examples of the gallic acid derivatives used are those as described in, for example, U.S. Pat. Nos. 3,457,079 and 3,069,262, etc. Specific examples of the p-alkoxyphenols are described in, for example, U.S. Pat. Nos. 2,735,765 and 3,698,909, Japanese Patent Publication Nos. 20977/74 and 6623/77, etc. Specific examples of the p-oxyphenol derivatives used are those as described in, for example, U.S. Pat. Nos. 3,432,300, 3,573,050, 3,574,627 and 3,764,337, Japanese Patent Application (OPI) Nos. 35633/77, 147434/77 and 152225/77, etc. Specific examples of the bisphenols used are those as described in, for example, U.S. Pat. No. 3,700,455, etc. Further, the use of the gallic acid derivatives together with is particularly preferred in some cases in view of the sensitivity-graininess ratio.

The present invention will be explained in greater detail with reference to the following examples, but the present invention should not be construed as being limited thereto.

EXAMPLE 1

In order to evaluate the effectivity of the application of the present invention, Samples 101 to 110 containing a yellow coupler were prepared by coating on a cellulose triacetate film support provided with a subbing layer a coating solution as described below which was prepared by mixing the silver halide emulsion as described in Table 1-1 below with a dispersion of the yellow coupler dissolved in tricresyl phosphate. The coated amount of each compound is shown in $g/m^2$ or $mol/m^2$ in parentheses.

(1) Emulsion Layer

A silver iodobromide negative type emulsion (silver coated amount: $2.1\times10^{-2}$ $mol/m^2$, iodide content: 7 mol%, grain size: as shown in Table 1-1 below)

Coupler ($1.5\times10^{-3}$ $mol/m^2$)

Tricresyl phosphate (1.10 g/m²)
Gelatin (2.30 g/m²)
(2) Protective Layer
Sodium salt of 2,4-dichloro-6-hydroxy-s-triazine (0.08 g/m²)
Gelatin (1.80 g/m²)

TABLE 1 - 1

| Silver Halide Emulsion | [1] (μm) | [2] (%) | [3] (%) |
|---|---|---|---|
| A | 0.8 | 15 | 0 |
| B | 1.0 | 30 | 10 |
| C | 1.3 | 60 | 45 |
| D | 1.8 | 75 | 60 |
| E | 2.0 | 85 | 75 |

[1]: average grain size corresponding to the projected area of grains.
[2]: area ratio that takes grains having 1.5 μm or more of a diameter corresponding to the projected area of grains.
[3]: area ratio that takes grains having 1.8 μm or more of a diameter corresponding to the projected area of grains.

These films were preserved under the conditions of 40° C. and 70% relative humidity for 14 hours, and then they were subjected to sensitometric exposure and the following color development processing at a temperature of 38° C.

| | |
|---|---|
| 1. Color Development | 2 min 45 sec |
| 2. Bleaching | 6 min 30 sec |
| 3. Water Washing | 3 min 15 sec |
| 4. Fixing | 6 min 30 sec |
| 5. Water Washing | 3 min 15 sec |
| 6. Stabilizing | 3 min 15 sec |

The processing solutions used above had the following compositions:

Color Developing Solution:

| | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1 liter |

Bleaching Solution:

| | |
|---|---|
| Ammonium bromide | 160.0 g |
| Aqueous ammonia (28%) | 25.0 ml |
| Sodium iron ethylenediaminetetraacetate | 130 g |
| Glacial acetic acid | 14 ml |
| Water to make | 1 liter |

Fixing Solution:

| | |
|---|---|
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |

Stabilizing Solution:

| | |
|---|---|
| Formalin | 8.0 ml |
| Water to make | 1 liter |

The density of the thus processed samples was measured using a blue filter. The results obtained are shown in Table 1-2 below.

TABLE 1 - 2

| Sample | Silver Halide Emulsion | Coupler | Fog | Relative* Sensitivity |
|---|---|---|---|---|
| 101 (Comparison) | A | Cp-1 | 0.13 | 59 |
| 102 (Comparison) | B | Cp-1 | 0.15 | 100 |
| 103 (Comparison) | C | Cp-1 | 0.15 | 178 |
| 104 (Comparison) | D | Cp-1 | 0.16 | 309 |
| 105 (Comparison) | E | Cp-1 | 0.16 | 380 |
| 106 (Comparison) | A | Y-19 | 0.13 | 59 |
| 107 (Comparison) | B | Y-19 | 0.15 | 100 |
| 108 (Present Invention) | C | Y-19 | 0.14 | 200 |
| 109 (Present Invention) | D | Y-19 | 0.17 | 355 |
| 110 (Present Invention) | E | Y-19 | 0.17 | 479 |

*Relative sensitivity is shown by a reciprocal of an exposure amount required for obtaining a density of fog + 0.8 and being taken the sensitivity of Sample 102 as 100.

From the results shown in Table 1-2 above it is understood that Samples 108 to 110 according to the present invention exhibit great increase in sensitivity in comparison with Samples 103 to 105 in which the conventional coupler providing a non-diffusible dye is employed in combination with the silver halide emulsion, while the increase in sensitivity is not observed in the combinations of the silver halide emulsions A and B having a grain size out of the scope of the present invention and the dye diffusible type coupler. Further, it is recognized as the result of microscopic observation of these processed films that the graininess of Samples 108 to 110 is clearly improved compared with Samples 103 to 105. From these results it is apparent that the application of the present invention is effective.

Further, Samples 111 to 118 were prepared in the same manner as described for Samples 101 to 110 except using an equimolar amount of the dye diffusible type magenta coupler M-3 according to the present invention or the comparison coupler Cp-2 in place of the yellow coupler used in Samples 101 to 110. These samples were subjected to the sensitometric exposure and color development processing as described above, and the photographic properties were evaluated using a green filter. The results thus obtained are shown in Table 1-3 below.

TABLE 1 - 3

| Sample | Silver Halide Emulsion | Coupler | Fog | Relative* Sensitivity |
|---|---|---|---|---|
| 111 (Comparison) | B | Cp-2 | 0.14 | 100 |
| 112 (Comparison) | C | Cp-2 | 0.14 | 158 |
| 113 (Comparison) | D | Cp-2 | 0.14 | 245 |
| 114 (Comparison) | E | Cp-2 | 0.15 | 302 |
| 115 (Comparison) | B | M-3 | 0.13 | 102 |
| 116 (Present Invention) | C | M-3 | 0.14 | 170 |
| 117 (Present Invention) | D | M-3 | 0.14 | 282 |
| 118 (Present Invention) | E | M-3 | 0.16 | 363 |

*Relative sensitivity is taken the sensitivity of Sample 111 as 100.

From the results shown in Table 1-3 above it is understood that Samples 116 to 118 according to the present invention clearly exhibit high sensitivity in comparison with Samples 112 to 114 using the corresponding conventional coupler. Further, it is recognized as the result of microscopic observation of these processed films that the graininess of the samples according to the present invention is improved. In these cases, the effectivity of the present invention is again illustrated.

Moreover, Samples 121 to 126 were prepared in the same manner as described for Samples 101 to 110 except using an equimolar amount of the dye diffusible type cyan coupler C-2 according to the present invention or the comparison coupler Cp-3 in place of the yellow coupler used in Samples 101 to 110. These samples were subjected to the sensitometric exposure and color development processing as described above, and the photographic properties were evaluated using a red filter. The results thus obtained are shown in Table 1-4 below.

TABLE 1 - 4

| Sample | Silver Halide Emulsion | Coupler | Fog | Relative* Sensitivity |
|---|---|---|---|---|
| 121 (Comparison) | B | Cp-3 | 0.16 | 100 |
| 122 (Comparison) | C | Cp-3 | 0.16 | 174 |
| 123 (Comparison) | D | Cp-3 | 0.17 | 289 |
| 124 (Comparison) | B | C-2 | 0.16 | 102 |
| 125 (Present Invention) | C | C-2 | 0.16 | 195 |
| 126 (Present Invention) | D | C-2 | 0.17 | 347 |

*Relative sensitivity is taken the sensitivity of Sample 121 as 100.

From the results shown in Table 1-4 above it is understood that the increase in sensitivity can be achieved in cases of using the cyan couplers by means of the application of the present invention. Further it is observed that the graininess is also improved same as the cases using the yellow coupler and the magenta coupler according to the present invention.

Couplers Cp-1 to Cp-3 which were used for comparison have the following structures:

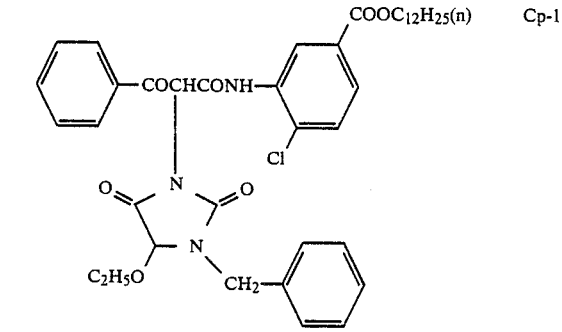

Cp-1

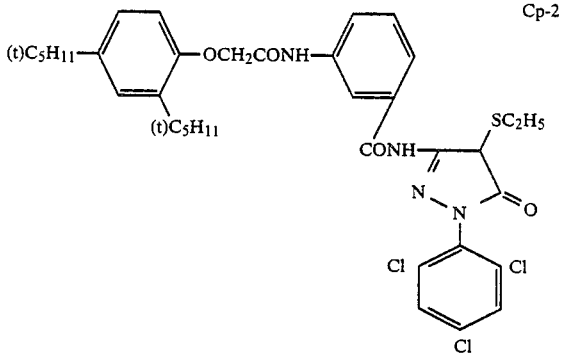

Cp-2

-continued

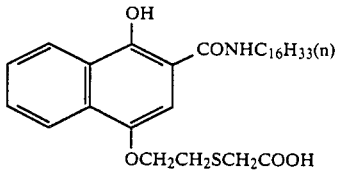

Cp-3

EXAMPLE 2

Sample 201

On a cellulose triacetate film support were coated layers having the compositions set forth below to prepare a multilayer color photographic light-sensitive material.

First Layer:

Antihalation Layer (AHL)

A gelatin layer containing black colloidal silver

Second Layer:

Intermediate Layer (ML)

A gelatin layer containing a dispersion of 2,5-di-tert-octylhydroquinone

Third Layer:

First Red-Sensitive Emulsion Layer ($RL_1$)

A silver iodobromide emulsion (iodide content: 5 mol%, average grain size: 0.5μ), silver coated amount: 1.90 g/m²

| | |
|---|---|
| Sensitizing Dye I | $6 \times 10^{-4}$ mol per mol of silver |
| Sensitizing Dye II | $1.5 \times 10^{-4}$ mol per mol of silver |
| Coupler Cp-4 | 0.04 mol per mol of silver |
| Coupler Cp-5 | 0.003 mol per mol of silver |
| Coupler Cp-6 | 0.0006 mol per mol of silver |

Fourth Layer:

Second Red-Sensitive Emulsion Layer ($RL_2$)

Silver iodobromide emulsion F, silver coated amount: 1.6 g/m²

| | |
|---|---|
| Sensitizing Dye I | $2.5 \times 10^{-4}$ mol per mol of silver |
| Sensitizing Dye II | $1.0 \times 10^{-4}$ mol per mol of silver |
| Coupler Cp-3 | 0.02 mol per mol of silver |
| Coupler Cp-5 | 0.0016 mol per mol of silver |

Fifth Layer:

Intermediate Layer (ML)

Same as the Second Layer

Sixth Layer:

First Green-Sensitive Emulsion Layer ($GL_1$)

A silver iodobromide emulsion (iodide content: 4 mol%, average grain size: 0.45μ), silver coated amount: 1.6 g/m²

| | |
|---|---|
| Sensitizing Dye III | $3 \times 10^{-4}$ mol per mol of silver |
| Sensitizing Dye IV | $1 \times 10^{-4}$ mol per mol of silver |
| Coupler Cp-7 | 0.05 mol per mol of silver |
| Coupler Cp-8 | 0.008 mol per mol of silver |
| Coupler Cp-6 | 0.0015 mol per mol of silver |

Seventh Layer:

Second Green-Sensitive Emulsion Layer ($GL_2$)

A silver iodobromide emulsion (iodide content: 8 mol%, average grain size: 0.9μ), silver coated amount: 1.8 g/m²

| | |
|---|---|
| Sensitizing Dye III | $2.5 \times 10^{-4}$ mol per mol of silver |

-continued

| | |
|---|---|
| Sensitizing Dye IV | $0.8 \times 10^{-4}$ mol per mol of silver |
| Coupler Cp-9 | 0.003 mol per mol of silver |
| Coupler Cp-10 | 0.017 mol per mol of silver |

Eight Layer:

Yellow Filter Layer (YFL)

A gelatin layer containing yellow colloidal silver and a dispersion of 2,5-di-tert-octylhydroquinone Ninth Layer:

First Blue-Sensitive Emulsion Layer ($BL_1$)

A silver iodobromide emulsion (iodide content: 6 mol, average grain size: 0.5μ), silver coated amount: 0.7 g/m²

| | |
|---|---|
| Coupler Cp-11 | 0.25 mol per mol of silver |
| Coupler Cp-6 | 0.015 mol per mol of silver |

Tenth Layer:

Second Blue-Sensitive Emulsion Layer ($BL_2$)

A silver iodobromide emulsion (iodide content: 8 mol%, average grain size: 1.0μ), silver coated amount: 1.1 g/m²

| | |
|---|---|
| Coupler Cp-11 | 0.06 mol per mol of silver |

Eleventh Layer:

Protective Layer (PL)

A gelatin layer containing polymethyl methacrylate particles (having a diameter of 1.5μ)

A gelatin hardener H-1 and a surface active agent were incorporated into each of the layers in addition to the above-described components.

The sample thus prepared was designated Sample 201.

Samples 202 to 204

Samples 202, 203 and 204 were prepared in the same manner as described for Sample 201 except using an equimolar amount of Couplers C-8, C-2 and C-15 according to the present invention in place of Coupler Cp-3 in $RL_2$ of Sample 201, respectively.

Sample 205

Sample 205 was prepared in the same manner as described for Sample 201 except using the same Silver coated amount of silver iodobromide emulsion G according to the present invention in place of silver iodobromide emulsion F in $RL_2$ of Sample 201.

Samples 206 to 208

Samples 206, 207 and 208 were prepared in the same manner as described for Sample 205 except using an equimolar amount of Couplers C-8, C-2 and C-15 according to the present invention in place of Coupler Cp-3 in $RL_2$ of Sample 205, respectively.

Samples 201 to 208 were subjected to sensitometric exposure with white light and then to the same color development processing as described in Example 1. The density of the thus processed samples was measured using red light. The photographic properties obtained are shown in Table 2 below.

TABLE 2

| Sample | Emulsion | Coupler | Relative* Sensitivity |
|---|---|---|---|
| 201 (Comparison) | F | Cp-3 | 100 |
| 202 (Comparison) | F | C-8 | 95 |
| 203 (Comparison) | F | C-2 | 100 |
| 204 (Comparison) | F | C-15 | 105 |
| 205 (Comparison) | G | Cp-3 | 214 |
| 206 (Present Invention) | G | C-8 | 252 |
| 207 (Present Invention) | G | C-2 | 263 |
| 208 (Present Invention) | G | C-15 | 269 |

*Relative sensitivity is shown by a reciprocal of an exposure amount required for obtaining a density of fog + 0.2 and being taken the sensitivity of Sample 201 as 100.

From the results shown in Table 2 above it is understood that of Samples 205 to 208 in which Emulsion G according to the present invention is used, Samples 206 to 208 using the dye diffusible type couplers according to the present invention exhibit high sensitivity in comparison with Sample 205 using the conventional coupler Cp-3 while in Samples 201 to 204 in which Emulsion F is used there is substantially no difference in sensitivity between the conventional coupler Cp-3 and the dye diffusible type couplers according to the present invention. Further, the processed samples were observed using a microscope of 40 magnifications through red filter and found that the graininess of Samples 205 to 208 is clearly improved in comparison with Samples 201 to 204. From these results the effectivity of the present invention is illustrated.

The silver iodobromide emulsion and the compounds used for preparing Samples 201 to 208 are as follows:

Silver Iodobromide Emulsion F iodide content:

8.0 mol%, average grain size corresponding to the projected area of grains: 1.1μ, ratio that takes grains having 1.5 μm or more of a diameter corresponding to the projected area of grains: 15%

Silver Iodobromide Emulsion G iodide content:

10.0 mol%, average grain size corresponding to the projected area of grains: 1.6μ, ratio that takes grains having 1.5 μm or more of a diameter corresponding to the projected area of grains: 65%.

Sensitizing Dye I

Pyridinium salt of anhydro-5,5'-dichloro-3,3'-di(γ-sulfopropyl)-9-ethylthiacarbocyanine hydroxide Sensitizing Dye II Triethylamine salt of anhydro-9-ethyl-3,3'-di(γ-sulfopropyl)-4,5,4',5'-dibenzothiacarbocyanine hydroxide Sensitizing Dye III Sodium salt of anhydro-9-ethyl-5,5'-dichloro-3,3'-di(γ-sulfopropyl)oxacarbocyanine Sensitizing Dye IV Sodium salt of anhydro-5,6,5',6'-tetrachloro-1,1'-diethyl-3,3'-di{β-(γ-sulfopropoxy)ethoxy]ethyl}imidazolocarbocyanine hydroxide Cp-4

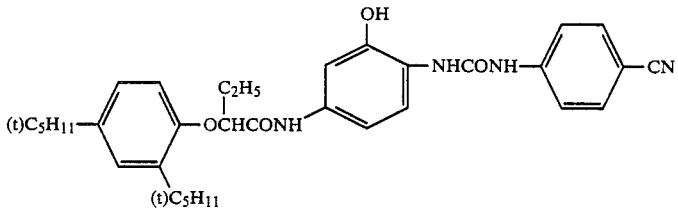

Cp-5

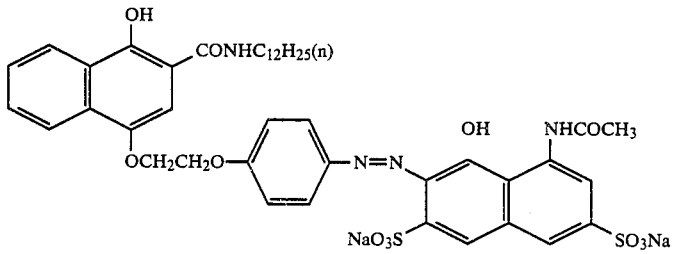

Cp-6

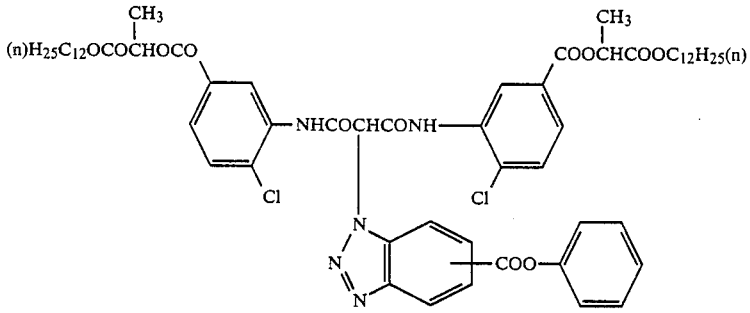

Cp-7

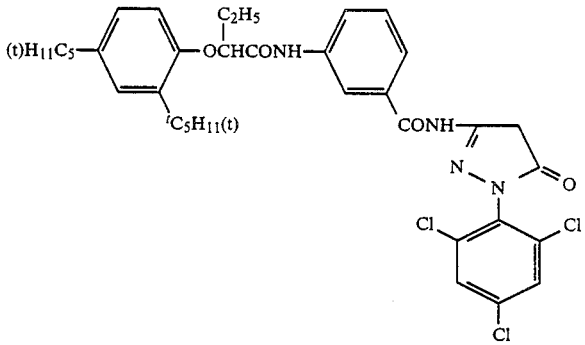

-continued

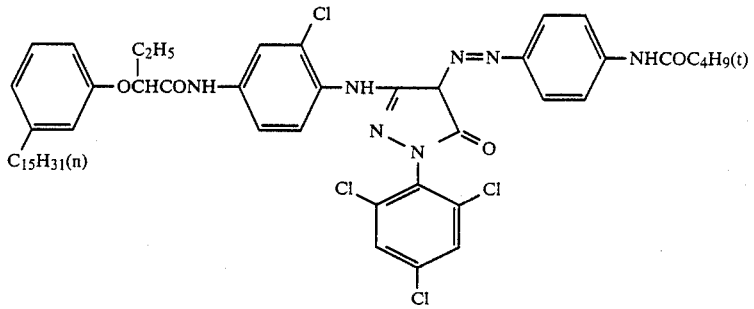

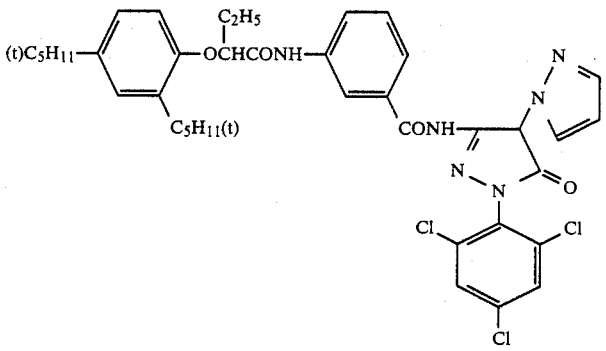

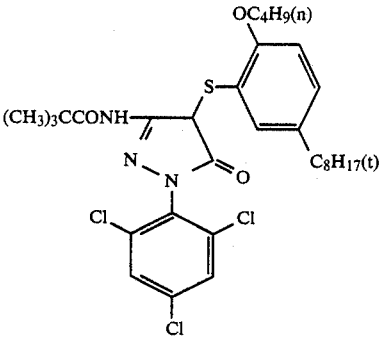

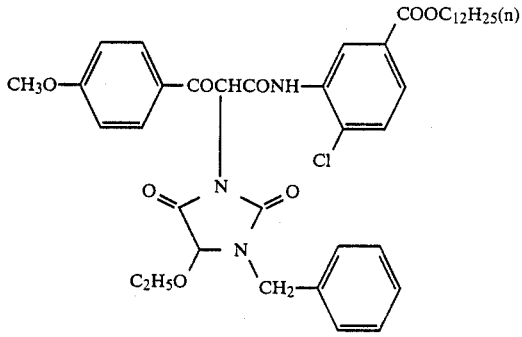

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer, wherein the photographic light-sensitive material has a layer containing both a non-diffusible coupler which forms a properly smearing diffusible dye upon reaction with an oxidation product of a color developing agent and silver halide emulsion in which a diameter corresponding to the projected area of grains that takes 40% or more of the projected area of whole silver halide grains is 1.5 um or more wherein the non-diffusible coupler which forms a properly smearing diffusible dye in a coupler represented by the general formula (A):

$$(Cp)_aX \qquad (A)$$

wherein Cp represents a diffusible coupler component which forms a proper smearing of dye images and improves graininess; X represents a component which is bonded to the coupling position of the coupler component, which is released upon the reaction with the oxidation product of the color developing agent and which contains a ballast group having from 8 to 32 carbon atoms; and a represents 1 or 2.

2. A silver halide photographic light-sensitive material as claimed in claim 1, wherein the photographic light-sensitive material has at least one red-sensitive silver halide emulsion layer containing a cyan color forming coupler, at least one green-sensitive silver halide emulsion layer containing a magenta color forming coupler and at least one blue-sensitive silver halide emulsion layer containing a yellow color forming coupler, and at least one of these silver halide emulsion layers contains both the non-diffusible coupler and the silver halide emulsion.

3. A silver halide photographic light-sensitive material as claimed in claim 1, wherein the non-diffusible coupler is present in an amount within the range of 0.005 to 0.5 mol per mol of silver halide.

4. A silver halide photographic light-sensitive material as claimed in claim 3, wherein the non-diffusible coupler is present in an amount within the range of 0.01 to 0.1 mol per mol of silver halide.

5. A silver halide photographic light-sensitive material as claimed in claim 1, wherein the non-diffusible coupler is a coupler represented by the following general formulae (I), (II) or (III):

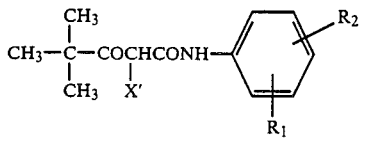

(I)

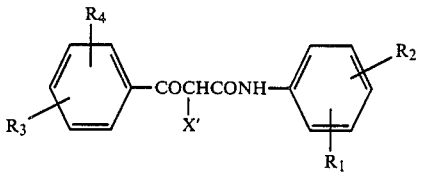

(II)

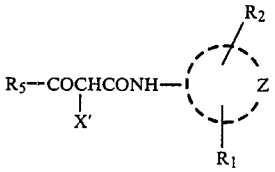

(III)

wherein $R_1$, $R_2$, $R_3$ and $R_4$, which may be the same or different, each represents a hydrogen atom, a halogen atom, an alkyl group, an alkoxy group, an aryloxy group, an acylamino group, a sulfonamino group, a carbamoyl group, a sulfamoyl group, an alkylthio group, an alkylsulfonyl group, an alkoxycarbonyl group, a ureido group, a cyano group, a carboxyl group, a hydroxy group, or a sulfo group; $R_5$ represents an alkyl group, an aryl group or an alkoxy group, provided that the total number of carbon atoms included in $R_1$, $R_2$, $R_3$, $R_4$ and $R_5$ is not more than 10; Z represents a non-metal atomic group necessary to form a heterocyclic group; and X' represents a group which contains a ballast group having from 8 to 32 carbon atoms, providing non-diffusibility to the coupler, and which is capable of being released upon a coupling reaction with an oxidation product of an aromatic primary amine developing agent.

6. A silver halide photographic light-sensitive material as claimed in claim 5, wherein the group represented by X' is an acyloxy group, a sulfonyloxy group, a sulfinyloxy group, a sulfamoyloxy group, a carbamoyloxy group, a thiocarbamoyloxy group, an oxamoyloxy group or a group represented by the following general formulae (IV) or (V):

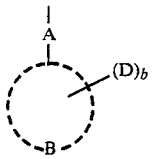

(IV)

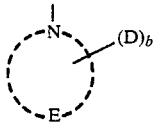

(V)

wherein A represents an oxygen atom or a sulfur atom; B represents a non-metal atomic group necessary to form an aryl ring or a heterocyclic ring; and E represents a non-metal atomic group necessary to form a 5-membered or 6-membered heterocyclic ring together with the nitrogen atom; these rings may be further condensed with an aryl ring or a heterocyclic ring; D represents a ballast group; and b represents a positive integer, when b is more than 1, D may be the same or different, and the total number of carbon atoms included is from 8 to 32.

7. A silver halide photographic light-sensitive material as claimed in claim 1, wherein the non-diffusible coupler is a coupler represented by the following general formulae (VI), (VII), (VIII) or (IX):

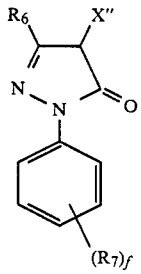

(VI)

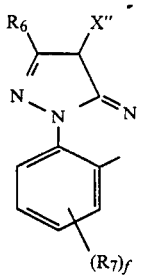

(VII)

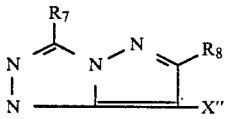

(VIII)

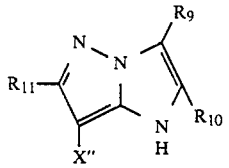

(IX)

wherein $R_6$ represents an acylamino group, an anilino group or a ureido group; $R_7$ and $R_8$ each represents a halogen atom, an alkyl group, an alkoxy group, an acylamino group, an alkoxycarbonyl group, an N-alkylcarbamoyl group, a ureido group, a cyano group, an aryl group, an N,N-dialkylsulfamoyl group, a nitro group, a hydroxy group, a carboxy group or an aryloxy group; f represents an integer of from 0 to 4, when f is two or more, $R_7$ may be the same or different; $R_9$, $R_{10}$ and $R_{11}$ each represents a hydrogen atom, an alkyl group, an aryl group, a heterocyclic group, a cyano group, an alkoxy group, an aryloxy group, an acylamino group, an anilino group, a ureido group, a sulfamoylamino group, an alkylthio group, an arylthio group, an alkoxycarbonyl group, an alkoxycarbonylamino group, a sulfonamido group, a carbamoyl group, a sulfamoyl group or a sulfonyl group, provided that the total number of carbon atoms included in $R_6$ and $(R_7)_f$ of the general formulae (VI) and (VII), in $R_7$ and $R_8$ of the general formula (VIII) or in $R_9$, $R_{10}$ and $R_{11}$ of the general formula (IX) is not more than 10; and X″ represents a group which is bonded to the coupling position through an oxygen atom, a nitrogen atom or a sulfur atom and which is capable of being released upon a coupling reaction.

8. A silver halide photographic light-sensitive material as claimed in claim 7, wherein the group represented by X″ is a group represented by the following general formulae (X), (XI), (XII), (XIII) or (XIV):

$$-S-R_{12} \quad (X)$$

$$-O-R_{12} \quad (XI)$$

(XII)

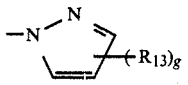

(XIII)

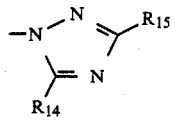

(XIV)

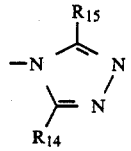

wherein $R_{12}$ represents an aliphatic group, an aromatic group or a heterocyclic group; g represents an integer of 1 to 3; $R_{13}$ represents a hydrogen atom, a halogen atom, an acylamino group, an alkoxy group, an alkoxycarbonyl group, a sulfamoyl group, a sulfonamido group, a carbamoyl group, an imido group, an aliphatic group, an aromatic group or a heterocyclic group, when g is two or more, $R_{13}$ may be the same or different; and $R_{14}$ and $R_{15}$ each has the same meaning as defined for $R_{13}$.

9. A silver halide photographic light-sensitive material as claimed in claim 8, wherein the aromatic group represented by $R_{12}$, $R_{13}$, $R_{14}$ or $R_{15}$ is a phenyl group which may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl substituted succinimido group, an aryloxy group, an aryloxycarbonyl group, an arylcarbamoyl group, an arylamido group, an arylsulfamoyl group, an arylsulfonamido group, an arylureido group, an amino group, a hydroxy group, a carboxy group, a sulfo group, a nitro group, an alkoxy group, a cyano group, a thiocyano group or a halogen atom.

10. A silver halide photographic light-sensitive material as claimed in claim 8, wherein the aliphatic group represented by $R_{12}$, $R_{13}$, $R_{14}$ or $R_{15}$ is an alkyl group substituted with an alkoxy group, an aryloxy group, an amino group, an acylamino group, a halogen atom, an aryl group, an alkoxycarbonyl group, a sulfonamido group, a sulfamoyl group, an alkylthio group, a carboxy group, an alkylsulfonyl group, an imido group, an alkanoyloxy group or an arylcarbonyloxy group.

11. A silver halide photographic light-sensitive material as claimed in claim 1, wherein the non-diffusible coupler is a coupler represented by the following general formulae (XV) or (XVI):

(XV)

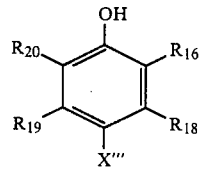

(XVI)

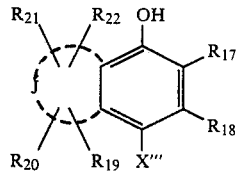

wherein $R_{16}$ represents a hydrogen atom, an aliphatic group having 10 or less carbon atoms, an alkoxy group having 10 or less carbon atoms, an aryloxy group, an acylamido group, a sulfonamido group and a ureido group represented by the general formulae (XVII) to (XIX) as described below, or a carbamoyl group represented by the general formula (XX) as described below;

$$-NH-CO-G \quad (XVII)$$

$$-NH-SO_2-G \quad (XVIII)$$

$$-NHCONH-G \quad (XIX)$$

(XX)

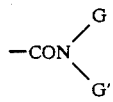

wherein G and G′, which may be the same or different, each represents a hydrogen atom, provided that G and G′ are not hydrogen atoms at the same time and that the total number of carbon atoms included in G and G′ is from 1 to 12, an aliphatic group having from 1 to 12 carbon atoms, an aryl group or a heterocyclic group, and each of these group may be substituted with a halogen atom, a nitro group, a cyano group, a hydroxy group, a carboxy group, an amino group, an alkyl group, an aryl group, an alkoxycarbonyl group, an acyloxycarbonyl group, an amido group, an imido group, a carbamoyl group, a sulfamoyl group, an alkoxy group, an aryloxy group or a sulfonyl group; $R_{17}$ represents a hydrogen atom, an aliphatic group having 12 or less carbon atoms or a carbamoyl group represented by the general formula (XX); $R_{18}$, $R_{19}$, $R_{20}$, $R_{21}$ and $R_{22}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group; J represents a non-metal atomic group necessary to form a 5-membered or 6-membered ring; and X‴ represents a group which contains a group having from 8 to 32 carbon atoms, which is bonded to the coupling position through —O—, —S—, or —N=N—, and which is capable of being released upon a coupling reaction with an oxidation product of an aromatic primary amine developing agent.

12. A silver halide photographic light-sensitive material as claimed in claim 11, wherein the group represented by X''' is an alkoxy group, an aryloxy group, an alkylthio group or an arylthio group, each having from 8 to 32 carbon atoms.

13. A silver halide photographic light-sensitive material as claim in claim 1, wherein the diameter corresponding to the projected area of grains that takes 40% or more of the projected area of whole silver halide grains is 1.7 μm or more.

14. A silver halide photographic light-sensitive material as claimed in claim 13, wherein the diameter is 1.8 μm or more.

15. A silver halide photographic light-sensitive material as claimed in claim 14, wherein the diameter is 2.0 μm or more.

16. A silver halide photographic light-sensitive material as claimed in claim 1, wherein the diameter corresponding to the projected area of grains that takes 50% or more of the projected area of whole silver halide grains is 1.5 μm or more.

17. A silver halide photographic light-sensitive material as claimed in claim 16, wherein the diameter corresponding to the projected area of grains that takes 70% or more of the projected area of whole silver halide grains is 1.5 μm or more.

18. A silver halide photographic light-sensitive material as claimed in claim 1, wherein the silver halide emulsion is a silver iodobromide emulsion containing 25 mol% or less of silver halide.

19. A method of forming a color image comprising developing an imagewise exposed silver halide photographic light-sensitive material comprising a support having thereon at least one silver halide emulsion layer, wherein the photographic light-sensitive material has a layer containing both a non-diffusible coupler which forms a properly smearing diffusible dye upon reaction with an oxidation product of a color developing agent and a silver halide emulsion in which a diameter corresponding to the projected area of grains that takes 40% or more of the projected area of whole silver halide grains is 1.5 μm or more with an aqueous alkaline solution containing a color developing agent, wherein the non-diffusible coupler which forms a properly smearing diffusible dye is a coupler represented by the following general formula (A):

$$(Cp)_aX \qquad (A)$$

wherein Cp represents a diffusible coupler component which forms a proper smearing of dye images and improves graininess; X represents a component which is bonded to the coupling position of the coupler component, which is released upon the reaction with the oxidation product of the color developing agent and which contains a ballast group having from 8 to 32 carbon atoms; and a represents 1 or 2.

* * * * *